US006494554B1

(12) United States Patent
Horii et al.

(10) Patent No.: US 6,494,554 B1
(45) Date of Patent: Dec. 17, 2002

(54) APPARATUS AND METHOD FOR DRIVING RECORDING HEAD FOR INK-JET PRINTER

(75) Inventors: Shinichi Horii, Kanagawa (JP); Yuichiro Ikemoto, Kanagawa (JP); Yasuo Yukita, Kanagawa (JP); Hiroshi Tokunaga, Tokyo (JP); Masaki Kishimoto, Kanagawa (JP); Yuji Yakura, Kanagawa (JP); Tooru Tanikawa, Kanagawa (JP); Shota Nishi, Kanagawa (JP); Kenji Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/200,019

(22) Filed: Nov. 25, 1998

(30) Foreign Application Priority Data

Nov. 28, 1997 (JP) ..... 9-327851
Dec. 17, 1997 (JP) ..... 9-348192
Dec. 17, 1997 (JP) ..... 9-348196

(51) Int. Cl.[7] ..... B41J 29/38
(52) U.S. Cl. ..... 347/10; 347/11
(58) Field of Search ..... 247/9, 10, 11, 247/40, 48, 68, 70

(56) References Cited

U.S. PATENT DOCUMENTS 4,364,069 A * 12/1982 Kobayashi ..... 347/71
4,888,598 A * 12/1989 Heinzl et al. ..... 347/70
5,170,177 A * 12/1992 Stanley et al. ..... 347/11
5,359,350 A * 10/1994 Nakano et al. ..... 347/10
5,576,743 A * 11/1996 Momose et al. ..... 347/11
5,627,576 A 5/1997 Inui et al. ..... 347/48
5,736,994 A * 4/1998 Takahashi ..... 347/11
5,757,401 A * 5/1998 Abe et al. ..... 347/48
5,877,789 A * 3/1999 Reinten ..... 347/48
6,095,630 A * 8/2000 Horii et al. ..... 347/10
6,318,829 B1 * 11/2001 Suzuki ..... 347/11

FOREIGN PATENT DOCUMENTS

EP 0580154 1/1994 ..... B41J/2/045
EP 8118622 5/1996 ..... B41J/2/045
EP 0738602 10/1996 ..... B41J/2/045
EP 0 827838 A * 3/1998 ..... B41J/2/21

* cited by examiner

*Primary Examiner*—John Barlow
*Assistant Examiner*—Alfred E. Dudding
(74) *Attorney, Agent, or Firm*—Jay H. Maioli

(57) ABSTRACT

An ink-jet printer and an apparatus and a method of driving a recording head for an ink-jet printer for suppressing satellite droplets. Two piezoelectric elements are provided for every ink chamber corresponding to each nozzle. Timing of displacement of the piezoelectric elements is adjusted by applying a drive signal for ink droplet ejection to one of the piezoelectric elements and a drive signal for suppressing satellite droplets when a droplet is ejected to the other piezoelectric element. An auxiliary pressure generated by the displacement of the latter piezoelectric element is superimposed on an ejection pressure generated by the displacement of the former piezoelectric element. Trailing of an ink droplet is cut off at an early stage and generation of satellite droplets is suppressed.

21 Claims, 25 Drawing Sheets voltage
drive signal 21a
F
G
Va
H
0
E
time 0
time
piezoeletric element 116a
P
displacement voltage
drive signal 21b
F′
G′
Vb
E′
H′
0V
time
td 0
time
piezoeletric element 116b
P′
displacement voltage
drive signal 21a′
F G
Va
E
H
0V
time 0
time
piezoeletric element 116a
displacement
P voltage
drive signal 21b′
F′ G′
Vb
E′
H′
0V
time 0
time
piezoeletric element 116b
displacement
P′ one cycle T
τ 2
τ 1 drive signal
145 − 1
V1
0V drive signal
145 − 2
V2
V1
0V
ts
ts′
ts

| name | piezo-electric element | drive signal waveform applied | retraction step | ejection step |
|---|---|---|---|---|
| α 1 | a | ① ① V1 0 | b | b |
| | b | ② ② V2 V1 0 | | |
| α 2 | a | ① ② V2 V1 0 | b | a |
| | b | ② ① V1 0 | | |
| α 3 | a | ① ② V2 V1 0 | b | a + b |
| | b | ② ② V2 V1 0 | | |

FIG.23

| name | piezo-electric element | drive signal waveform applied | retraction step | ejection step |
|---|---|---|---|---|
| β 1 | a | ② ① V1 0 | a | b |
| | b | ① ② V2 V1 0 | | |
| β 2 | a | ② ② V2 V1 0 | a | a |
| | b | ① ① V1 0 | | |
| β 3 | a | ② ② V2 V1 0 | a | a + b |
| | b | ① ② V2 V1 0 | | |

FIG.24

| name | piezo-electric element | drive signal waveform applied | retraction step | ejection step |
|---|---|---|---|---|
| γ 1 | a | ② ① V1 0 | a + b | b |
| | b | ② ② V2 V1 0 | | |
| γ 2 | a | ② ② V2 V1 0 | a + b | a |
| | b | ② ① V1 0 | | |
| γ 3 | a | ② ② V2 V1 0 | a + b | a + b |
| | b | ② ② V2 V1 0 | | |

FIG.25

| name | piezo-electric element | drive signal waveform applied | retraction step | ejection step |
|---|---|---|---|---|
| δ 1 | a | ① ① V1 0 | – | b |
| | b | ① ② V1 0 | | |
| δ 2 | a | ① ② V1 0 | – | a |
| | b | ① ① V1 0 | | |
| δ 3 | a | ① ② V1 0 | – | a + b |
| | b | ① ② V1 0 | | |

FIG.26

APPARATUS AND METHOD FOR DRIVING RECORDING HEAD FOR INK-JET PRINTER

BACKGROUND OF THE INVENTION

1. Field of the Invention

The present invention relates to an ink-jet printer for ejecting ink droplets through a droplet outlet orifice (a nozzle) and recording an image on paper and an apparatus and a method of driving a recording head for an ink-jet printer.

2. Description of the Related Art

Ink-jet printers for ejecting ink droplets through a droplet outlet orifice communicating with an ink chamber and recording on paper have been widely used. In such an ink-jet printer of related art, a single piezoelectric element is provided for each nozzle. The piezoelectric element is fixed to an oscillation plate forming an external wall of the ink chamber to which ink is fed through an ink duct. The piezoelectric element changes the ink chamber volume by bending in response to a voltage waveform of an applied drive signal so as to generate an ejection pressure. An ink droplet is ejected through the outlet orifice by the ejection pressure.

Since the ejection pressure is generated by changing the ink chamber in such an ink-jet printer as described above, ink ejected through the orifice flies in a columnar shape (in a trailing form). Differences in time and velocity result between the tip and the end of the flying ink droplet.

Consequently, the preceding main ink droplet is accompanied by unwanted minute droplets (called satellite droplets in the following description). Such satellite droplets landing on paper affect the printing result. Although satellite droplets do not have a great effect on the quality of a high-density image recorded with relatively large droplets, the image quality is expected to be significantly reduced by satellite droplets when the image is recorded with small droplets for representing a low-density image or a half-tone image. Satellite droplets generated when small droplets are ejected therefore cause a great problem.

Some methods have been proposed in order to cope with the problem. For example, a method is disclosed in Japanese Patent Application Laid-open Hei 7-76087 (1995) wherein a single piezoelectric element is provided for each nozzle and the velocity of changing ejection voltage applied to the piezoelectric element is switched between two levels for ejecting ink droplets. In the method, as shown in FIG. 1, the ejection voltage is initially increased at first voltage changing velocity 'v1'. The ejection voltage is then increased at second voltage changing velocity 'v2' higher than v1. In FIG. 1, the vertical axis indicates voltage. The horizontal axis indicates time. According to the method, the next droplet is ejected to follow the tip of the preceding droplet. The difference in velocity between the tip and the end of the ink column is thereby decreased and satellite droplets are reduced.

Another method is disclosed in Japanese Patent Application Laid-open Sho 59-133067 (1984) wherein a single piezoelectric element is provided for each nozzle and an ink droplet is ejected by applying two independent voltage pulses to the piezoelectric element. In the method, as shown in FIG. 2, first pulse P1 is applied to the piezoelectric element to produce a first pressure fluctuation for starting ink droplet ejection through a nozzle. First pulse P1 is then terminated and second pulse P2 is applied to the piezoelectric element before the ejection of droplet through the nozzle is completed to produce a second pressure fluctuation. In FIG. 2, the vertical axis indicates voltage. The horizontal axis indicates time. According to the method, the ink column ejected through the nozzle ruptures at an early stage and generation of satellite droplets is suppressed.

An ink droplet ejection apparatus is disclosed in Japanese Patent Application Laid-open Sho 51-45931 (1976) wherein two pressure generating means are provided for each nozzle and an ink droplet is ejected by oscillating ink by combining oscillations produced by the two pressure generating means.

In the method disclosed in Japanese Patent Application Laid-open Hei 7-76087 (1995) described above, however, first voltage changing velocity v1 is required to be lower than second voltage changing velocity v2. Consequently, the velocity of an ejected ink droplet is reduced when compared to the case wherein the voltage is changed at high velocity v2 throughout the ejection cycle. A reduction in velocity of an ejected ink droplet results in unstable ejection affecting linearity of the droplet flying route and variations in droplet velocity. As a result, displacements of recorded dots may occur and printing quality may be reduced.

In the method disclosed in Japanese Patent Application Laid-open Sho 59-133067 (1984) described above, second pulse P2 is applied after interval Ti, having terminated first pulse P1. If interval Ti is too long, a trail of an ink column becomes long and satellite droplets may be produced. On the other hand, if interval Ti is too short, the piezoelectric element does not follow the voltage change and the intended operation will not be achieved. This is because the piezoelectric element in general has its intrinsic oscillation characteristic and does not operate at a frequency above the intrinsic oscillation. Although this problem may be solved by fabricating a piezoelectric element having a high intrinsic frequency, this is not realistic since there is a limitation of the intrinsic frequency of the piezoelectric element obtained in practice. In addition, fabricating such a piezoelectric element is accompanied by technical difficulties and manufacturing costs are thereby increased. Furthermore, in the above-mentioned publication, although voltage V1 of first pulse P1 is lower than voltage V2 of second pulse P2, voltage V1 is required to be higher than voltage V2 so that the trailing end of the ink column reaches the tip thereof and becomes integrated with the tip. However, an increase in the voltage applied to the piezoelectric element causes a reduction in the life of the piezoelectric element and the oscillation plate oscillated by the piezoelectric element. A residual oscillation is increased as well and the frequency characteristic may be affected.

The above-mentioned ink droplet ejection apparatus disclosed in Japanese Patent Application Laid-open Sho 51-45931 (1976) is provided for efficiently ejecting ink droplets with a small power input. In order to achieve the object, high-frequency drive signals are each applied to the two pressure generating means and the phase difference between the drive signals and the amplitude are changed so that the oscillations generated by the pressure generating means are successfully combined to oscillate ink. An ink droplet is thereby ejected. That is, the apparatus is not intended for preventing satellite droplets. The method of driving the pressure generating means and the configuration required for preventing satellite droplets are not disclosed, either. No suggestion about such a method or configuration is made in the publication, either.

As thus described, it is difficult to satisfactorily reduce satellite droplets in the related art without reductions in velocity of an ejected droplet, in the apparatus life, in the frequency characteristic and without a limitation of the intrinsic oscillation characteristic of the piezoelectric element.

The related-art ink-jet printers have further problems. FIG. 3 is a schematic diagram of a recording head and a drive circuit thereof in a related-art ink-jet printer. As shown, a recording head 500 includes a nozzle 501 and a piezoelectric element 502 provided in correspondence with the nozzle 501. The piezoelectric element 502 is fixed to a wall of an ink chamber (not shown) to which ink is supplied through an ink duct (not shown). A drive signal 504 of a specific waveform is selectively inputted to the piezoelectric element 502 through an on/off switch 503. That is, the drive signal 504 is only inputted to the piezoelectric element 502 when the switch 503 is turned on. On the application of the drive signal 504, the piezoelectric element 502 is bent in such a direction that the ink chamber volume is reduced. An ink droplet is thereby ejected through the nozzle 501.

For such printers, one of the methods for producing halftone images is varying a droplet size dot by dot. In the drive circuit of the recording head of related art shown in FIG. 3, however, only one type of drive signal 504 is inputted so that merely whether to perform ejection or not is the only operation that is controlled. Consequently, it is impossible to perform control for varying a size of ejected droplet from droplet to droplet although the interval between recorded dots is controlled. It is therefore difficult to faithfully achieve various image representations such as more natural halftone images.

SUMMARY OF THE INVENTION

It is an object of the invention to provide an ink-jet printer and an apparatus and a method of driving a recording head for an ink-jet printer for suppressing generation of satellite droplets accompanying an ejected ink droplet while overcoming the problems described above.

An ink-jet printer of the invention comprises: a droplet outlet orifice through which an ink droplet is ejected; an ink chamber for supplying ink to the outlet orifice; a first pressure generating means for generating a pressure for having the ink droplet ejected through the outlet orifice by changing the volume of the ink chamber through displacement; a second pressure generating means for generating a pressure for suppressing generation of minute ink droplets accompanying the ink droplet ejected through the outlet orifice by changing the volume of the ink chamber through displacement; and an ejection control means for controlling a state of the displacements of the first and second pressure generating means.

An apparatus of the invention is provided for driving a recording head for an ink-jet printer including a droplet outlet orifice through which an ink droplet is ejected; an ink chamber for supplying ink to the outlet orifice; a first pressure generating means for generating a pressure for having the ink droplet ejected through the outlet orifice by changing the volume of the ink chamber through displacement; a second pressure generating means for generating a pressure for suppressing generation of minute ink droplets accompanying the ink droplet ejected through the outlet orifice by changing the volume of the ink chamber through displacement. The apparatus comprises: a means for generating drive signals for effecting the displacements of the first and second pressure generating means; and a means for controlling a state of supplying the drive signals to the first and second pressure generating means.

A method of the invention is provided for driving a recording head for an ink-jet printer including a droplet outlet orifice through which an ink droplet is ejected; an ink chamber for supplying ink to the outlet orifice; first and second pressure generating means provided for the outlet orifice. The method comprises the steps of: generating an ejection pressure for having the ink droplet ejected through the outlet orifice by changing the volume of the ink chamber through displacement of the first pressure generating means by applying drive signals for ejection having a specific waveform to the first pressure generating means; and generating an auxiliary pressure for suppressing generation of minute ink droplets accompanying the ink droplet ejected through the outlet orifice by changing the volume of the ink chamber through displacement of the second pressure generating means by applying an auxiliary drive signal having a specific waveform to the second pressure generating means. A state of the generation of the ejection pressure and a state of the generation of the auxiliary pressure are controlled.

According to the ink-jet printer and the apparatus and method of driving a recording head for an ink-jet printer of the invention, the first and second pressure generating means are provided for the outlet orifice. A state of the displacements of the first and second pressure generating means is adjusted. The auxiliary pressure generated by the displacement of the second pressure generating means is superimposed on the ejection pressure generated by the displacement of the first pressure generating means. Trailing of ink droplet is thereby cut off at an early stage.

Another ink-jet printer of the invention comprises: a droplet outlet orifice through which an ink droplet is ejected; an ink chamber, having a wall, for supplying ink to the outlet orifice; a first pressure generating means provided on the wall of the ink chamber for generating a pressure for having the ink droplet ejected through the outlet orifice by changing the volume of the ink chamber through displacement; a second pressure generating means provided on the wall of the ink chamber for generating a pressure for assisting the ejection of the ink droplet through the outlet orifice by changing the volume of the ink chamber through displacement. The first pressure generating means is placed further from the droplet outlet orifice than the second pressure generating means. 'Assisting with the ejection of the ink droplet' means that adjustment is made so that the ink droplet is ejected in an intended state. To be specific, a specific modification is made on the ejection pressure generated by the first pressure generating means so that the ejected droplet has an intended size and velocity or no unwanted droplet is ejected. The same applies to the following description. For example, the second pressure generating means may generate a pressure for suppressing generation of minute ink droplets accompanying the ink droplet ejected.

Another apparatus of the invention is provided for driving a recording head for an ink-jet printer including a droplet outlet orifice through which an ink droplet is ejected; an ink chamber, having a wall, for supplying ink to the outlet orifice; a first pressure generating means provided on the wall of the ink chamber for generating a pressure by changing the volume of the ink chamber through displacement; and a second pressure generating means provided on the wall of the ink chamber for generating a pressure by changing the volume of the ink chamber through displacement. The first pressure generating means is placed further from the droplet outlet orifice than the second pressure generating means. The apparatus comprises: a means for generating a main drive signal for having the first pressure generating means generate a pressure for ejecting the ink droplet through the outlet orifice and an auxiliary drive signal for having the second pressure generating means generate a pressure for assisting the ejection of the ink droplet through the outlet orifice; and a control means for performing control such that the main drive signal and the auxiliary drive signal are each supplied to the first pressure generating means and the second pressure generating means. The auxiliary drive signal may be the signal generating a pressure for suppressing generation of minute ink droplets accompanying the ink droplet.

Another method of the invention is provided for driving a recording head for an ink-jet printer including a droplet outlet orifice through which an ink droplet is ejected; an ink chamber, having a wall, for supplying ink to the outlet orifice; a first pressure generating means provided on the wall of the ink chamber for generating a pressure by changing the volume of the ink chamber through displacement; and a second pressure generating means provided on the wall of the ink chamber for generating a pressure by changing the volume of the ink chamber through displacement. The first pressure generating means is placed further from the droplet outlet orifice than the second pressure generating means. The method comprises the steps of: applying a main drive signal to the first pressure generating means for generating a pressure for ejecting the ink droplet through the outlet orifice; and applying an auxiliary drive signal to the second pressure generating means for generating a pressure for assisting the ejection of the ink droplet through the outlet orifice.

According to the ink-jet printer of the invention, the first pressure generating means is provided on the wall of the ink chamber in the position away from the outlet orifice. The volume of the ink chamber is changed by the displacement of the first pressure generating means and a pressure is generated for having the ink droplet ejected through the orifice. The second pressure generating means is provided on the wall of the ink chamber in the position closer to the outlet orifice the first pressure generating means. The volume of the ink chamber is changed by the displacement of the second pressure generating means and a pressure is generated for assisting the droplet ejection.

According to the apparatus and method of driving a recording head for an ink-jet printer of the invention, the main drive signal is applied to the first pressure generating means provided on the wall of the ink chamber in the position away from the outlet orifice for generating a pressure for ejecting the ink droplet through the orifice. The auxiliary signal is applied to the second pressure generating means provided on the wall of the ink chamber in the position closer to the outlet orifice for generating a pressure for assisting the droplet ejection. The droplet ejection is thereby controlled.

Still another ink-jet printer of the invention comprises: a droplet outlet orifice through which an ink droplet is ejected; a plurality of energy generating means each for generating energy for having the ink droplet ejected through the outlet orifice; and a plurality of selection means each provided for the respective energy generating means for selecting any of a plurality of drive signals for driving the energy generating means and supplying the signal to the respective energy generating means.

Still another apparatus of the invention is provided for driving a recording head for an ink-jet printer including a droplet outlet orifice through which an ink droplet is ejected; and a plurality of energy generating means each for generating energy for having the ink droplet ejected through the outlet orifice. The apparatus comprises: a means for generating a plurality of drive signals for driving the energy generating means; and a plurality of selection means each provided for the respective energy generating means for selecting any of the drive signals and supplying the signal to the respective energy generating means.

Still another method of the invention is provided for driving a recording head for an ink-jet printer including a droplet outlet orifice through which an ink droplet is ejected; and a plurality of energy generating means each for generating energy for having the ink droplet ejected through the outlet orifice. The method comprises the steps of: selecting any of a plurality of drive signals for driving the energy generating means for each of the energy generating means; and supplying the selected drive signal to the respective energy generating means.

According to the ink-jet printer and the apparatus and method of driving a recording head for an ink-jet printer of the invention, one of the drive signals is selected and supplied to each of the plurality of energy generating means. An ink droplet is ejected through the orifice with the drive signal.

Other and further objects, features and advantages of the invention will appear more fully from the following description.

BRIEF DESCRIPTION OF THE DRAWINGS

FIG. 23 shows some of ejection patterns selected and composed by the selectors shown in FIG. 19.

FIG. 24 shows other ejection patterns selected and composed by the selectors shown in FIG. 19.

FIG. 25 shows still other ejection patterns selected and composed by the selectors shown in FIG. 19.

FIG. 26 shows still other ejection patterns selected and composed by the selectors shown in FIG. 19.

DETAILED DESCRIPTION OF THE PREFERRED EMBODIMENTS

Preferred embodiments of the invention will now be described in detail with reference to the accompanying drawings.

[First Embodiment]

Figure 1:
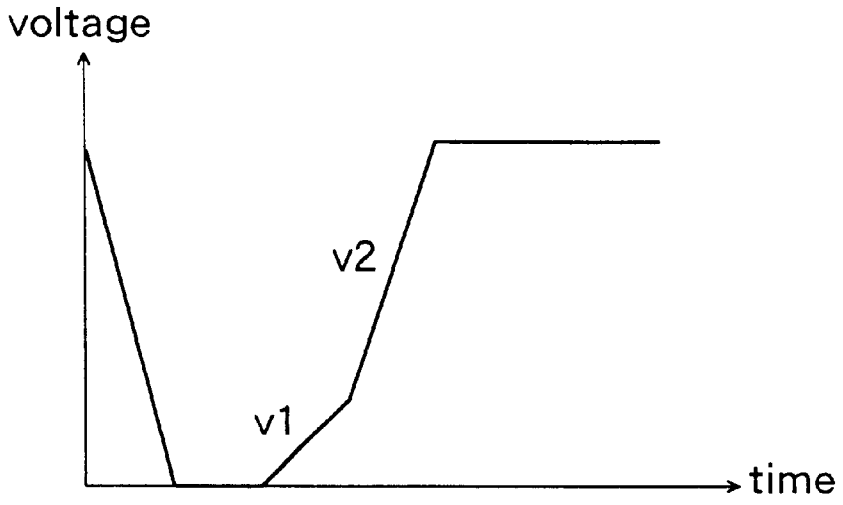
FIG.1 RELATED ART
FIG. 1 is a plot for illustrating a method of driving a related-art ink-jet printer.
Figure 2:
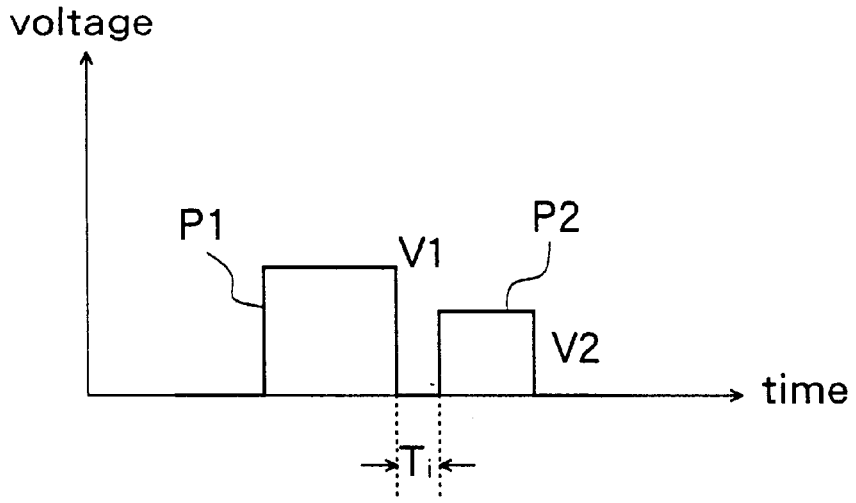
FIG.2 RELATED ART
FIG. 2 is a plot for illustrating a method of driving another related-art ink-jet printer.
Figure 3:
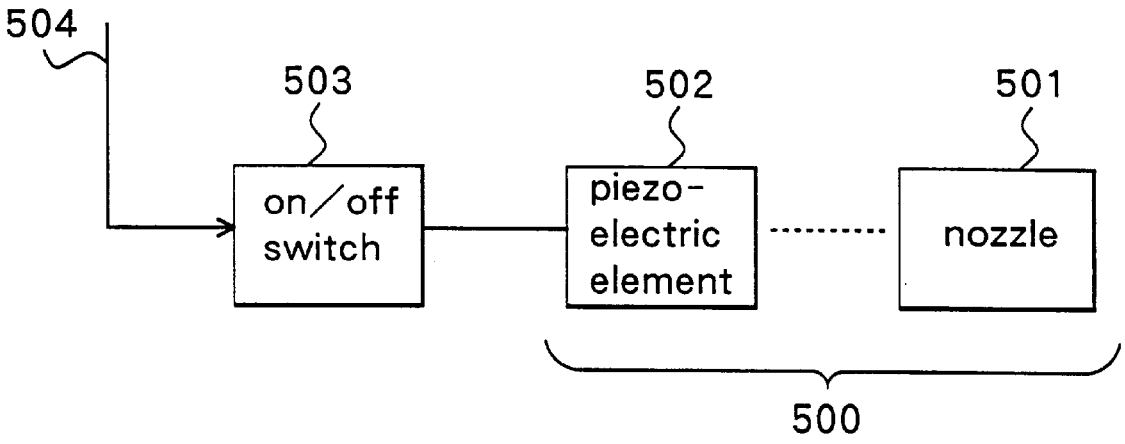
FIG.3 RELATED ART
FIG. 3 is a block diagram of a recording head and a drive circuit thereof of a related-art ink-jet printer.
Figure 4:
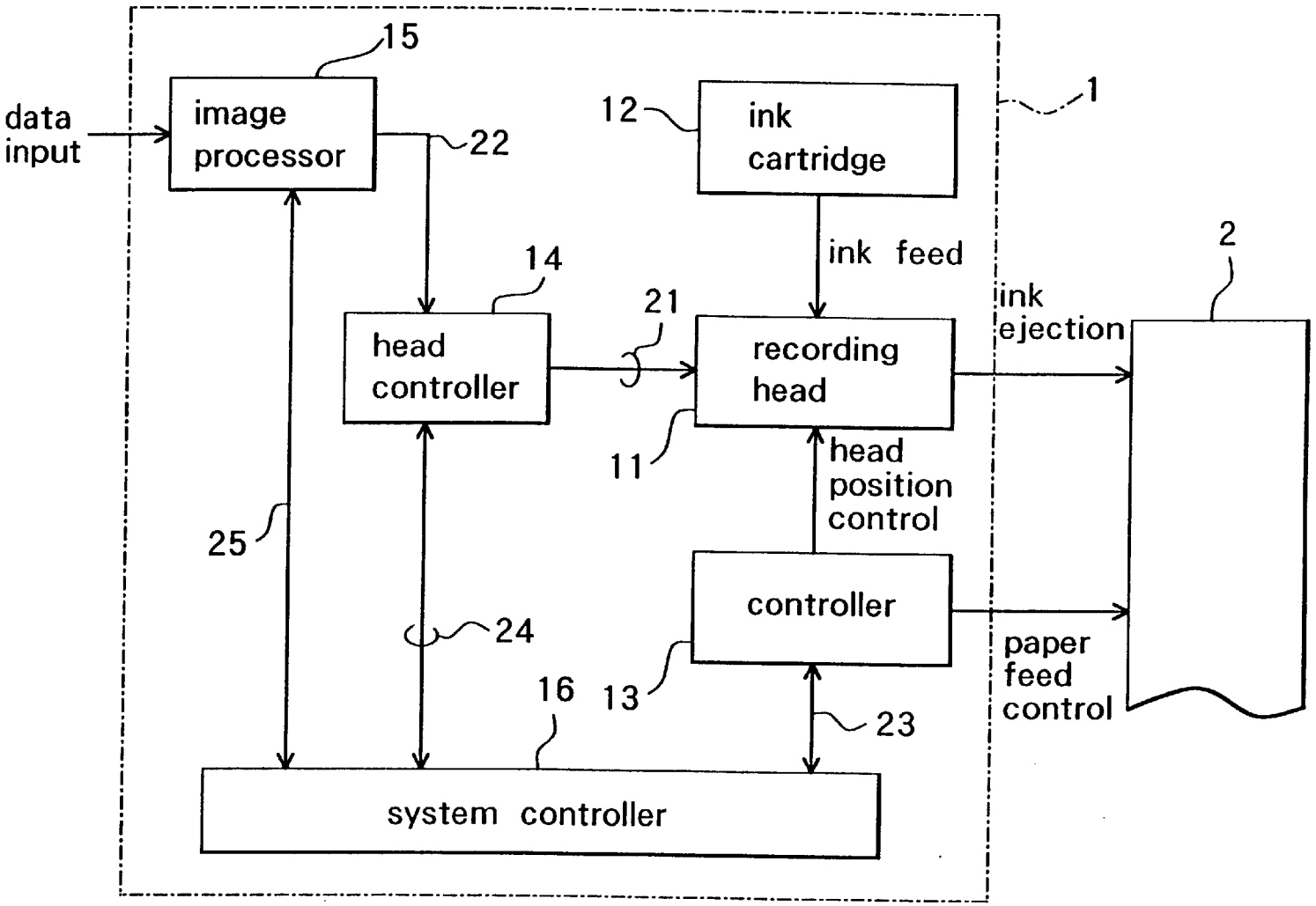
FIG. 4 is a block diagram of an ink-jet printer of a first embodiment of the invention.

FIG. 4 is a schematic diagram for illustrating the main part of an ink-jet printer of a first embodiment of the invention. Although a multi-nozzle head ink-jet printer having a plurality of nozzles will be described in the embodiment, the invention may be applied to a single-nozzle head ink-jet printer having a single nozzle. An apparatus and a method of driving a recording head of an ink-jet printer of the embodiment which are implemented with the ink-jet printer of the embodiment will be described as well.

An ink-jet printer 1 comprises: a recording head 11 for recording on recording paper 2 by ejecting ink droplets thereon; an ink cartridge 12 for feeding ink to the recording head 11; a controller 13 for controlling the position of the recording head 11 and feeding of the paper 2; a head controller 14 for controlling ink droplet ejection of the recording head 11 with a drive signal 21; an image processor 15 for performing a specific image processing on input image data and supplying the data as image printing data 22 to the head controller 14; and a system controller 16 for controlling the controller 13, the head controller 14 and the image processor 15 with control signals 23, 24 and 25, respectively. The head controller 14 corresponds to an 'ejection control means' of the invention.

Figure 5:
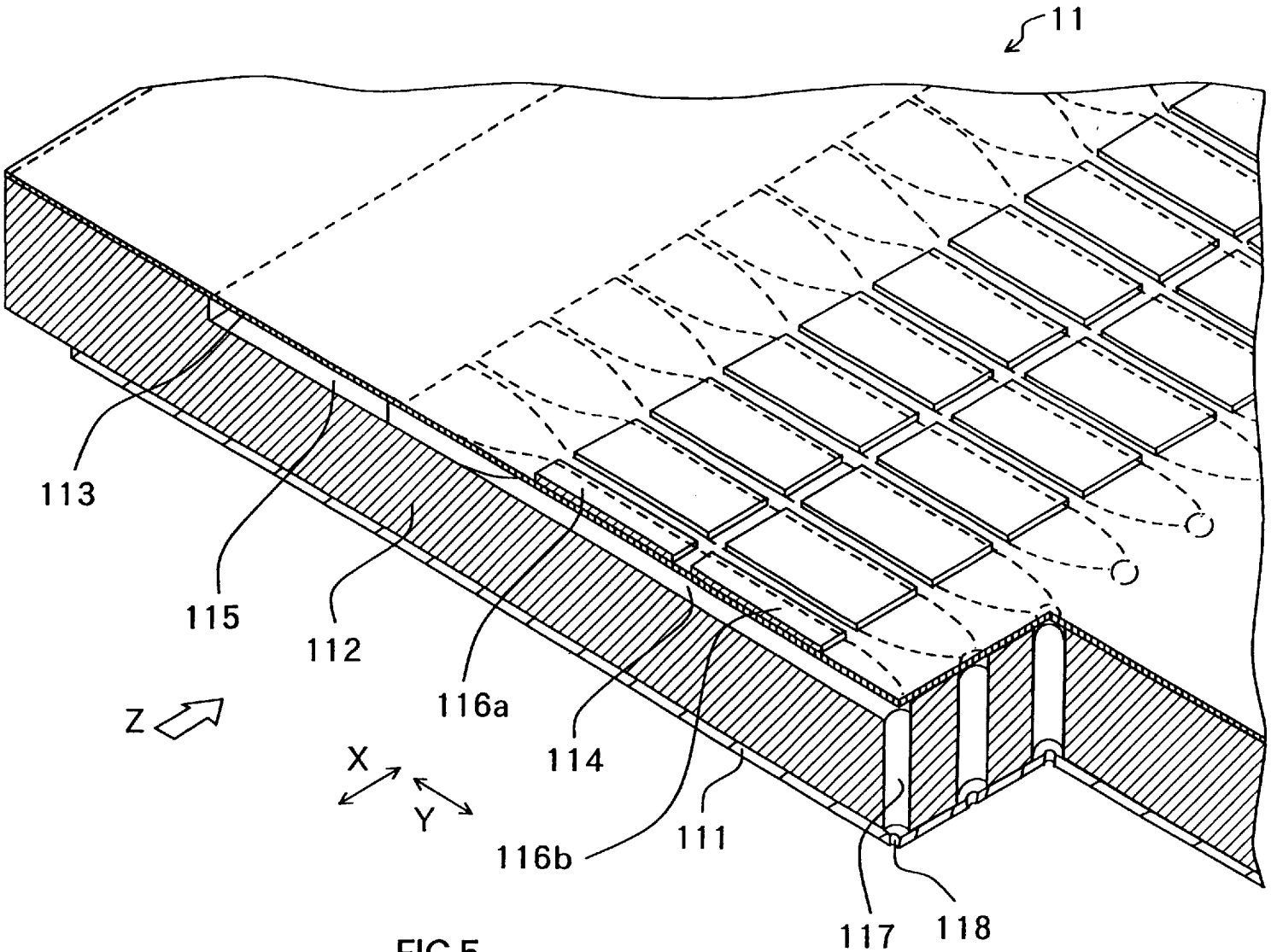
FIG. 5 is a perspective cross section of an example of recording head.
Figure 6:
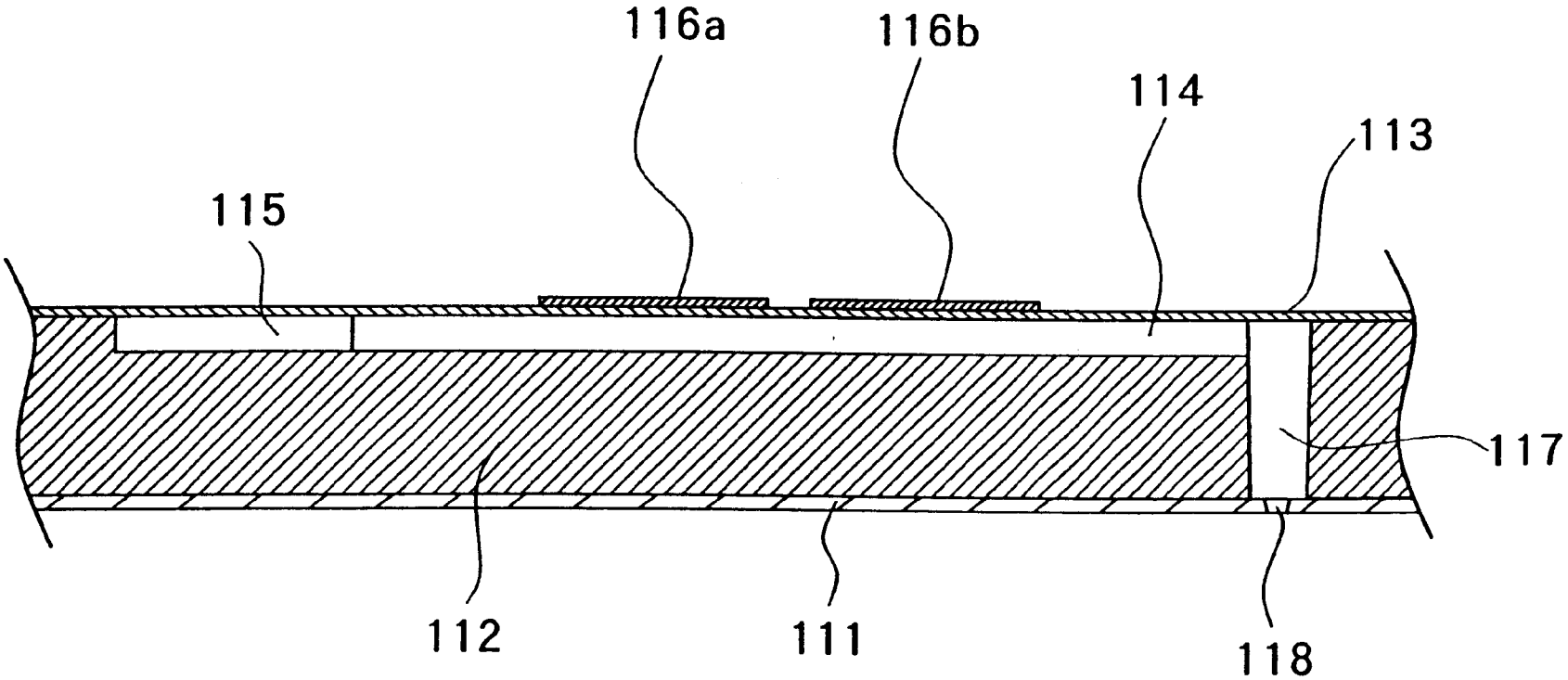
FIG. 6 is a cross section of the recording head.

FIG. 5 is a perspective cross section of the recording head 11 shown in FIG. 4. FIG. 6 is a cross section of the recording head 11 shown in FIG. 5 viewed in the direction of arrow Z. As shown, the recording head 11 comprises a thin nozzle plate 111, a duct plate 112 stacked on the nozzle plate 111; and an oscillation plate 113 stacked on the duct plate 112. The plates are bonded to each other with an adhesive not shown, for example.

Concave are selectively formed on the upper surface of the duct plate 112. The concave areas and the oscillation plate 113 make up a plurality of ink chambers 114 and a shared duct 115 communicating with the ink chambers 114. Communicating sections between the shared duct 115 and the ink chambers 114 are narrow. The width of each ink chamber 114 increases towards the direction opposite to the shared duct 115. A pair of piezoelectric elements 116*a* and 116*b* are each fixed to the oscillation plate 113 directly above each ink chamber 114. Electrodes not shown are placed on the upper and lower surfaces of each of piezoelectric elements 116*a* and 116*b*. A drive signal from the head controller 14 (FIG. 4) is applied to the electrodes. Each of the piezoelectric elements 116*a* and 116*b* and the oscillation plate 113 are thereby bent so as to increase (expand) and reduce (contract) the volume of each ink chamber 114. The ink chamber corresponds to an 'ink chamber' of the invention.

In the embodiment, the piezoelectric elements 116*a* and 116*b* are formed such that the amounts of displacement (called displacement capacity in the following description) in response to the same applied voltage are equal to each other. The piezoelectric elements 116*a* and 116*b* are therefore made of the same material and have the same thickness and surface area. As a result, a specific change in volume of ink chamber 114 is effected by the same applied voltage. Alternatively, the displacement capacities of the piezoelectric elements 116*a* and 116*b* may be changed by varying the thickness and surface areas between the elements 116*a* and 116*b*. The piezoelectric element 116*a* corresponds to a 'first pressure generating means' and the piezoelectric element 116*b* corresponds to a 'second pressure generating means' of the invention.

The width of the section of each ink chamber 114 opposite to the side communicating with the shared duct 115 is reduced by degrees. At the end of the ink chamber 114, a duct hole 117 is formed through the thickness of the duct plate 112. The duct hole 117 communicates with a minute nozzle 118 formed in the nozzle plate 111 which is the lowest of the plates. An ink droplet is ejected through the nozzle 118. In the embodiment the recording head 11 has a plurality of nozzles 118 at even intervals in a row along the direction (arrow X in FIG. 5) of feeding the paper 2 (FIG. 4). The nozzles 118 may be arranged in any other way such as in two staggered two rows. The nozzle 118 corresponds to a 'droplet outlet orifice' of the invention.

The shared duct 115 communicates with the ink cartridge 12 shown in FIG. 4 (not shown in FIG. 5 and FIG. 6). Ink is regularly fed into each ink chamber 114 at a constant speed from the ink cartridge 12 through the shared duct 115. Such ink feed may be performed by capillarity. Alternatively, a pressure mechanism may be provided for feeding ink by applying a pressure to the ink cartridge 12.

By a carriage drive motor and an associated carriage mechanism not shown, the recording head 11 of such a configuration is reciprocated in direction Y orthogonal to direction X in which the paper 2 is carried while ejecting ink droplets. An image is thereby recorded on the paper 2.

Although not shown, the head controller 14 is made up of a microprocessor; a read only memory (ROM) for storing a program executed by the microprocessor; a random access memory (RAM) as a work memory used for particular computations performed by the microprocessor and temporary data storage and so on; a drive waveform storage section made up of nonvolatile memory; a digital-to-analog (D-A) converter for converting digital data read from the storage section into analog data; and an amplifier for amplifying an output of the D-A converter. The drive waveform storage section retains pairs of waveform data items representing voltage waveforms of drive signals 21*a* and 21*b* for driving the piezoelectric elements 116*a* and 116*b* of each nozzle of the recording head 11. The waveform data items are made through entering various values for the parameters (time and voltage parameters) shown in FIG. 7, for example. There is a specific relationship described below maintained between each pair of the drive signals 21*a* and 21*b*. The waveform data items are each read by the microprocessor and converted to analog signals by the D-A converter. The signals are amplified by the amplifier and outputted as pairs of the drive signals 21*a* and 21*b*. The number of the pairs is equal to the number of nozzles 'n'. The configuration of the head controller 14 is not limited to the one described above but may be implemented in any other way.

Of the pair of drive signals, the drive signal 21*a* is applied to the piezoelectric element 116*a* of the corresponding nozzle. The drive signal 21*b* is applied to the piezoelectric element 116*b* of the corresponding nozzle. In FIG. 4, pairs of the drive signals 21*a* and 21*b* wherein the number of the pairs is 'n' are shown as the drive signal 21.

Figure 7A:
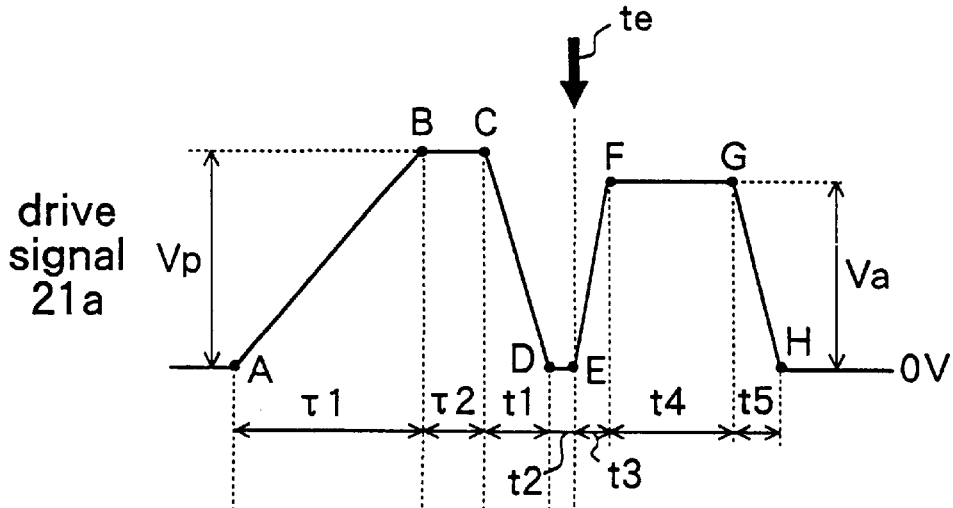
FIG. 7A and FIG. 7B show examples of drive signals outputted from the head controller shown in FIG. 4.
Figure 7B:
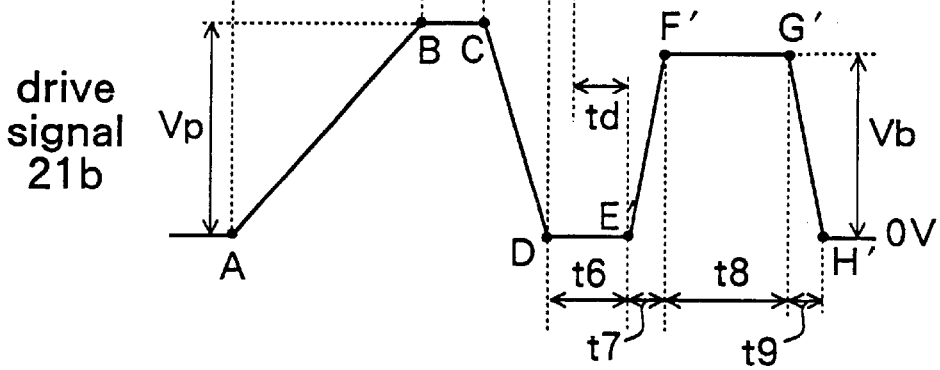

FIG. 7A and FIG. 7B show examples of one cycle (T) of waveforms of the drive signals 21*a* and 21*b*. FIG. 7A and FIG. 7B each show the drive signals 21*a* and 21*b*, respectively. The vertical axis indicates voltage. The horizontal axis indicates time. Time proceeds from left to right in the graphs. Of the drive signals, the drive signal 21*a* is a drive signal for generating a pressure for ejecting an ink droplet. The voltage of the drive signal 21*a* includes retraction voltage Vp and ejection voltage Va besides reference voltage 0 V. The drive signal 21*b* is an auxiliary drive signal for generating a pressure for suppressing satellite droplets when an ink droplet is ejected. The voltage of the drive signal 21*b* includes retraction voltage Vp and auxiliary voltage Vb besides reference voltage 0 V. The pair of the drive signals 21*a* and 21*b* is appropriately switched to another pair by the head controller 14 between the ejection cycles and supplied to the corresponding nozzle.

Figures 8A, 8B, 8C:
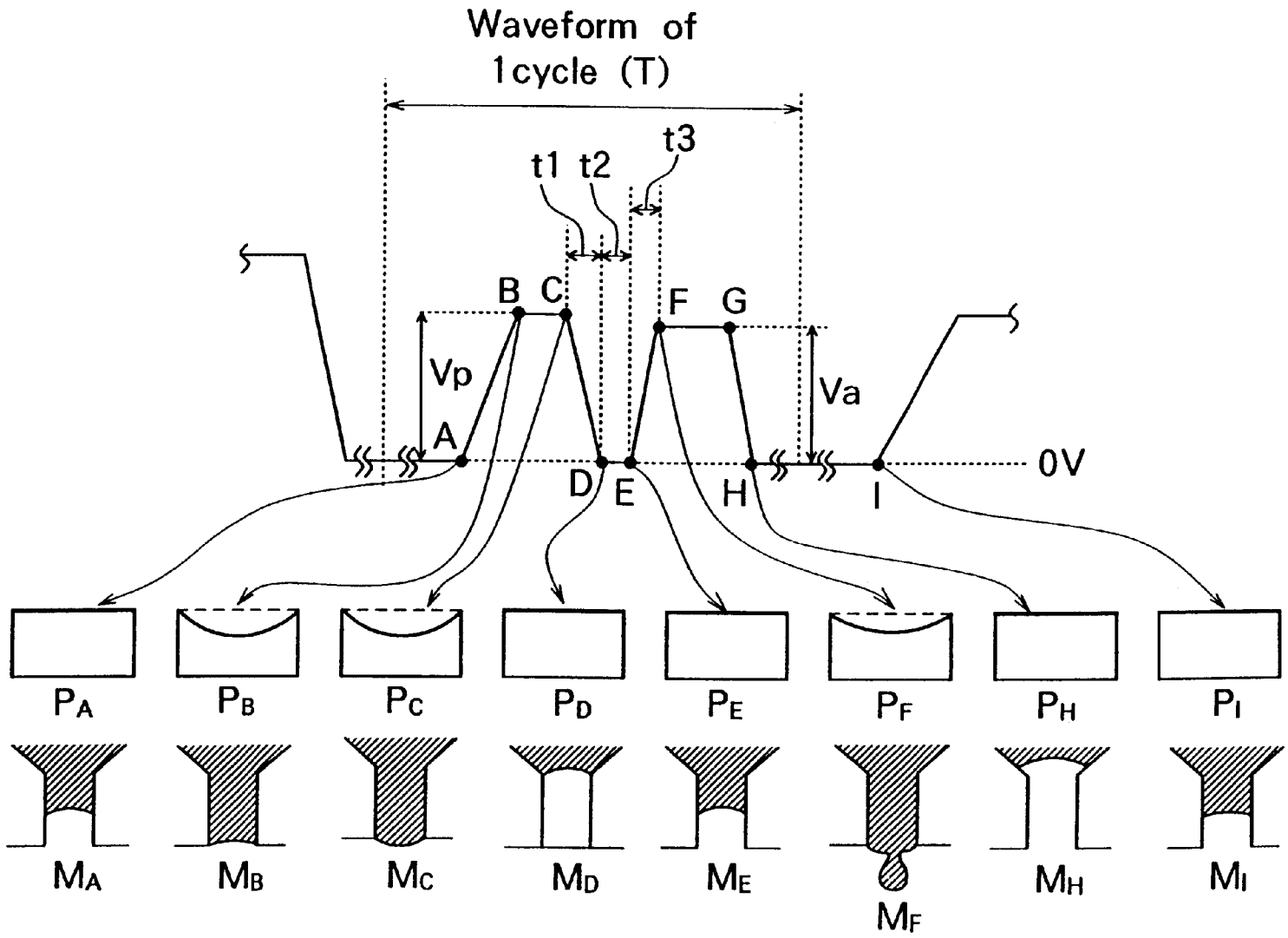
FIG. 8A to FIG. 8C show the relationship among the waveform of the drive signal for ejection shown in FIG. 7A, the state of ink chamber and the meniscus position in the nozzle.

Reference is now made to FIG. 8A to FIG. 8C for describing the significance of the drive signal 21*a*. FIG. 8A to FIG. 8C show the relationship among the waveform of the drive signal, the behavior of the piezoelectric element 116*a* to which the drive signal is applied; and the change in position of extremity of ink in the nozzle 118 (referred to as meniscus position in the following description). FIG. 8A shows a nearly one cycle of the waveform of the typical drive signal 21*a*. FIG. 8B illustrates the changing state of the ink chamber 114 when the drive signal 21*a* having a waveform as shown in FIG. 8A is applied to the piezoelectric element 116*a*. FIG. 8C illustrates the changing meniscus positions in the nozzle 118.

In FIG. 8A, a first preceding step is the step in which a drive voltage is changed from the reference voltage of 0V to retraction voltage Vp (from A to B). A second preceding step is the step in which retraction voltage Vp to the reference voltage of 0V (from C to D). Time required for the first step is defined as t1. A second step is the step in which the voltage of 0V is maintained to be on standby (from D to E). Time required for the second step is defined as t2. A third step is the step in which the voltage of 0V is changed to ejection voltage Va (from E to F). Time required for the third step is defined as t3.

In the embodiment point E at which the third step is started is the point at which ejection is started. The first and second preceding steps and the first and second steps precede the start of ejection.

At and before point A, since the voltage applied to the piezoelectric element 116*a* is 0V, there is no bend in the oscillation plate 113 and the volume of the ink chamber 114 is maximum as $P_A$ in FIG. 8B. At point A, as $M_A$ in FIG. 8C, the meniscus position in the nozzle 118 retreats from the nozzle edge by a specific distance.

Next, the first preceding step is performed for gradually increasing the drive voltage from the voltage of 0 V at point A to retraction voltage Vp at point B. The oscillation plate 113 is thereby bent inward and the ink chamber 114 is contracted ($P_B$ in FIG. 8B). Since the contraction speed of the ink chamber 114 is slow, the reduction in volume of the ink chamber 114 allows the meniscus position in the nozzle 118 to advance and causes backflow of ink into the shared duct 115. The ratio of the amount of ink flowing forward to the amount flowing backward mainly depends on the flow passage resistance in the nozzle 118 and that in the communicating section between the ink chamber 114 and the shared duct 115. By optimizing the ratio, the meniscus position at point B is controlled to almost reach the nozzle edge, as $M_B$ in FIG. 8C, without projecting from the nozzle edge.

Next, the second preceding step is performed for maintaining the volume of the ink chamber 114 constant ($P_C$ in FIG. 8B) by keeping the drive voltage at retraction voltage $V_P$ from point B to point C. Since ink is continuously fed from the ink cartridge 12 during this step, the meniscus position in the nozzle 118 shifts towards the nozzle edge. At point C the meniscus position advances to the position slightly protruding from the nozzle edge as $M_C$ in FIG. 8C.

Next, the first step is performed for reducing the drive voltage from retraction voltage Vp at point C to the reference voltage of 0 V at point D. The voltage applied to the piezoelectric element 116 is thereby reduced to zero so that the bend in the oscillation plate 113 is eliminated and the ink chamber 114 is expanded as $P_D$ in FIG. 8B. Consequently, the meniscus in the nozzle 118 is retracted towards the ink chamber 114. At point D the meniscus retreats as deep as $M_D$ in FIG. 8C, that is, moves away from the nozzle edge. The amount of retraction of the meniscus in the first step is changed by changing retraction voltage Vp, that is, the potential difference between points C and D. It is thereby possible to control the droplet size. This is because the droplet size depends on the meniscus position at the start point of ejection and the deeper the meniscus position, the smaller the droplet size is.

Next, the second step is performed for maintaining the volume of the ink chamber 114 by fixing the drive voltage to zero so as to keep the oscillation plate 113 unbent during time t2 from point D to point E ($P_D$ to $P_E$ in FIG. 8C). During time t2 ink is continuously fed from the ink cartridge 12. The meniscus position in the nozzle 118 thus shifts towards the nozzle edge. The meniscus position proceeds as far as the state of $M_E$ shown in FIG. 8C. The amount of movement of the meniscus may be varied by changing time t2. in the second step. The meniscus position at the start point of the third step is thereby controlled. That is, the droplet size is controllable by adjusting time t2.

Next, the third step is performed for abruptly increasing the drive voltage from the voltage of 0 V at point E to ejection voltage Va at point F. Point E is the ejection start point as described above. At point F, the oscillation plate 113 is greatly bent inward as $P_F$ in FIG. 8B. The ink chamber 114 is thereby abruptly contracted. Consequently, as $M_F$ in FIG. 8C, the meniscus in the nozzle 118 is pressed towards the nozzle edge at a stretch through which an ink droplet is ejected. The droplet ejected flies in the air and lands on the paper 2 (FIG. 5).

Next, at point G until which a specific period has elapsed with the drive voltage maintained at ejection voltage Va, the drive voltage is reduced to 0V again. The oscillation plate 113 thereby returns to the unbent state as $P_H$ in FIG. 8B at point H. This state is maintained until point I at which the first preceding step of next ejection cycle is started ($P_I$ in FIG. 8B). At point H immediately after the drive voltage is reduced to 0V again, as $M_H$ in FIG. 8C, the meniscus position is retreated by the amount corresponding to the total of the volume of ink refilling, the meniscus position shifts to the level similar to $M_A$ at initial point A, as $M_I$ in FIG. 8C, at point I at which the first preceding step of next ejection cycle is started.

The cycle of ejection is thus completed. Such a cycle of operation is repeated for each of the nozzles 118 in a parallel manner. Image recording on the paper 2 (FIG. 5) is thereby continuously performed.

In the embodiment, time t2 required for the second step is less than the time required for the meniscus retracted in the first step to reach the nozzle edge. Ejection voltage Va in the third step falls within the range that allows ink droplet ejection. In FIG. 7A, time required for the periods other than CD, DE and EF is represented as: AB=τ1, BC=τ2, FG=t4, and GH=t5.

Referring again to FIG. 7A and FIG. 7B, the waveform of the drive signal 21*b* will now be described. In the embodiment, the section from A to D of the drive signal 21*b* is the same as the waveform of the drive signal 21*1*. Time t6 required for period DE' during which the voltage of 0 V is maintained is longer than time t2 required for the second step of the drive voltage 21*a*. Point E' at which the drive signal 21*a* starts to rise from the reference voltage of 0 V to auxiliary voltage Vb lags behind ejection start point 'te' (point E) of the drive signal 21*a* by time 'td'. In FIG. 7B time required for period E'F' during which the drive voltage 21*a* changes from the reference voltage of 0V to auxiliary voltage Vb is shown as 't7'. Time required from point F' at which the drive voltage 21*a* reaches auxiliary voltage Vb to terminal point G' of maintaining auxiliary voltage Vb is shown as 't8'. Time required for period G'H' during which the drive voltage 21*a* changes from auxiliary voltage Vb to the reference voltage of 0V is shown as 't9'. As will be described below, one of the features of the invention is that delay time td is appropriately determined.

The operation of the ink-jet printer 1 shown in FIG. 4 as a whole will now be briefly described.

In FIG. 4 printing data is inputted to the ink-jet printer 1 from an information processing apparatus such as a personal computer. The image processor 15 performs specific image processing on the input data (such as expansion of compressed data) and outputs the data as the image printing data 22 to the head controller 14.

On receipt of the image printing data 22 of 'n' dots corresponding to the number of nozzles of the recording head 11, the head controller 14 determines an ink droplet size for forming a dot for each nozzle 118 based on the image printing data 22. The head controller 14 then determines pairs of drive signals 21*a* and 21*b* each to be supplied to each nozzle based on the determined droplet sizes. For example, a pair of drive waveforms (wherein t2, Vp and Va are large) that achieve a droplet of large size are selected for representing high density. A pair of drive waveforms (wherein t2, Vp and Va are small) that achieve a droplet of small size are selected for representing low density or high resolution. For representing a delicate halftone image, a pair of drive waveforms that achieve a droplet size slightly different from neighboring dots are selected. If there are variations in droplet ejection characteristics among the nozzles, a pair of drive waveforms that adjust the variations may be selected.

Having determined the pairs of the drive signals for 'n' dots (that is, the drive signals to be supplied to the nozzles 118 whose number is 'n'), the head controller 14 supplies the selected drive signal 21*a* to the piezoelectric element 116*a* of each nozzle 118 of the recording head 11 at the point between the ejection cycles. At the same time, the head controller 14 supplies the selected drive signal 21*b* to the piezoelectric element 116*b* of each nozzle 118. The piezoelectric element 116*a* of each nozzle 118 performs the steps described with reference to FIG. 8B, in accordance with the voltage waveform of the supplied signal 21*a* for ejecting an ink droplet. The piezoelectric element 116*b* of each nozzle 118 is displaced in accordance with the voltage waveform of the supplied drive signal 21*b* and performs the operation for assisting the ejection performed by the piezoelectric element 116*a*.

Referring to FIG. 7A and FIG. 7B, FIG. 9A to FIG. 9D, and FIG. 10A and FIG. 10B, the functions specific to the ink-jet printer of the embodiment will now be described.

As described in the section on the related-art techniques, satellite droplets, that is, minute droplets produced when an ink droplet is ejected, are often generated in a system wherein an ink droplet is ejected by generating a pressure with a piezoelectric element. The trailing end of the ink flying in a columnar form is separated from the tip thereof due to differences in time and velocity. The separated end part of the ink forms minute droplets.

In the embodiment, in order to prevent generation of such satellite droplets, the ink chamber 114 is contracted by raising the drive signal 21*a* at point E (ejection start point 'te') and changing from the reference voltage of 0 V to ejection voltage Va. The ink chamber 114 is further contracted by raising the drive signal 21*a* from the reference voltage of 0 V to auxiliary voltage Vb while the drive signal 21*a* is maintained at ejection voltage Va and the ink chamber 114 is in the state of contraction. This feature will be further described, referring to FIG. 9A to FIG. 9D.

Figures 9A, 9B, 9C, 9D:
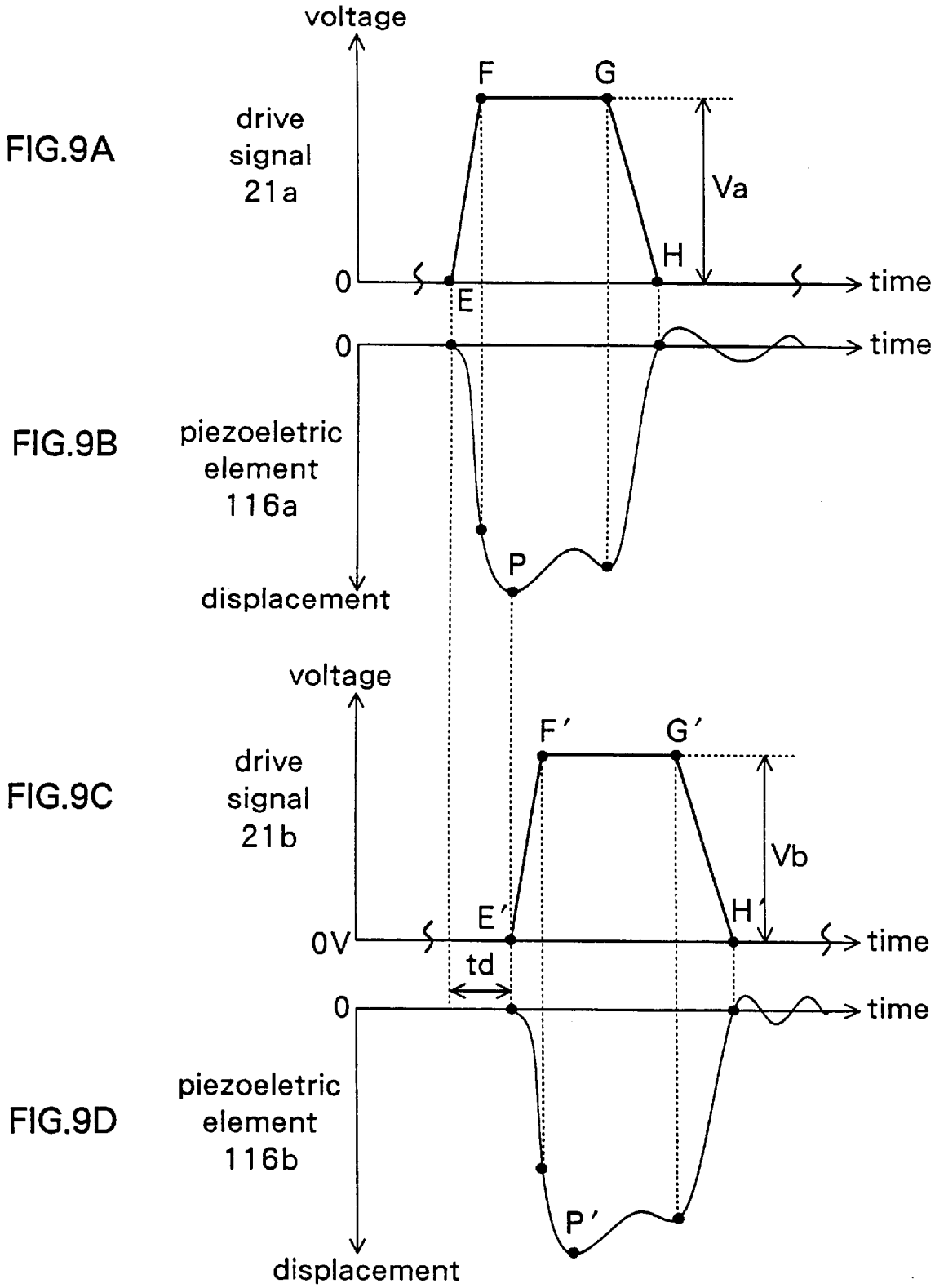
FIG. 9A to FIG. 9D show the relationship among the waveforms of the drive signals shown in FIG. 7A and FIG. 7B and the displacement amounts of the piezoelectric elements.

FIG. 9A to FIG. 9D show the relationship between changes of voltage waveforms of the drive signals 21*a* and 21*b* and displacements of the piezoelectric elements 116*a* and 116*b*. To be specific, FIG. 9A shows the main part of the waveform of the drive signal 21*a*. FIG. 9B shows the displacement of the piezoelectric element 116*a*. FIG. 9C shows the main part of the waveform of the drive signal 21*b*. FIG. 9D shows the displacement of the piezoelectric element 116*b*. The horizontal axes each indicate time. The vertical axes in FIG. 9A and FIG. 9C each indicate voltage. The vertical axes in FIG. 9B and FIG. 9D each indicate displacement.

As shown in FIG. 9A and FIG. 9B, the piezoelectric element 116*a* is shifted in the direction of contracting the ink chamber 114 with an increase in voltage of the drive signal 21*a* started from point E. The amount of displacement of the piezoelectric element 116*b* reaches maximum at point P that overruns point F at which the voltage reaches ejection voltage Va by an inertial force. The ink chamber 114 is most contracted at point P. As shown in FIG. 9C and FIG. 9D, the drive signal 21*b* starts to change from the reference voltage of 0 V to auxiliary voltage Vb at point P (that is, point E') at which the amount of displacement of the piezoelectric element 116*b* reaches maximum. The piezoelectric element 116*b* is thereby further shifted in the direction of contracting the ink chamber 114. The amount of displacement of the piezoelectric element 116*b* reaches a maximum at point P' that overruns point F' at which the voltage reaches ejection voltage Vb by an inertial force as described above. The ink chamber 114 is thus most contracted at point P'. In such a manner the time required for the piezoelectric element 116*a* to reach maximum displacement point P from the displacement of zero is defined as delay time 'td' in the embodiment.

The piezoelectric element 116*a* to which ejection voltage Va of the drive signal 21*a* is applied is shifted in the direction of contracting the ink chamber so as to generate a pressure in the ink chamber 114. Ink is ejected out of the nozzle 118 by the pressure. At this point the ink ejected out of the nozzle 118 is trailing and takes a columnar form. The piezoelectric element 116*b* to which auxiliary voltage Vb of the drive signal 21*b* is applied at the maximum displacement point of the piezoelectric element 116*a* is displaced so as to generate another pressure in the ink chamber 114. The ink column being ejected out of the nozzle 118 is further extruded by the pressure. The trailing end of the ink column therefore reaches the tip thereof and is integrated with the tip so as to form a single droplet. At the same time, discontinuity results in the ink flow and the ink column is cut immediately after the trailing end. The trail of the ink column is thereby prevented from extending and generation of satellite droplets is suppressed.

While ejection voltage Va is maintained, intrinsic oscillations are effected in the piezoelectric element 116*a*. The displacement of the piezoelectric element 116*a* returns to zero when the drive signal 21*a* changes from ejection voltage Va at point G to the reference voltage of 0 V at point H. Intrinsic oscillations that are gradually attenuating are further effected. Similarly, intrinsic oscillations are effected in the piezoelectric element 116*b* while auxiliary voltage Vb is maintained. The displacement of the piezoelectric element 116*b* returns to zero when the drive signal 21*b* changes from auxiliary voltage Vb at point G' to the reference voltage of 0 V at point H'. Intrinsic oscillations that is gradually attenuating are further effected.

Figures 10A, 10B:
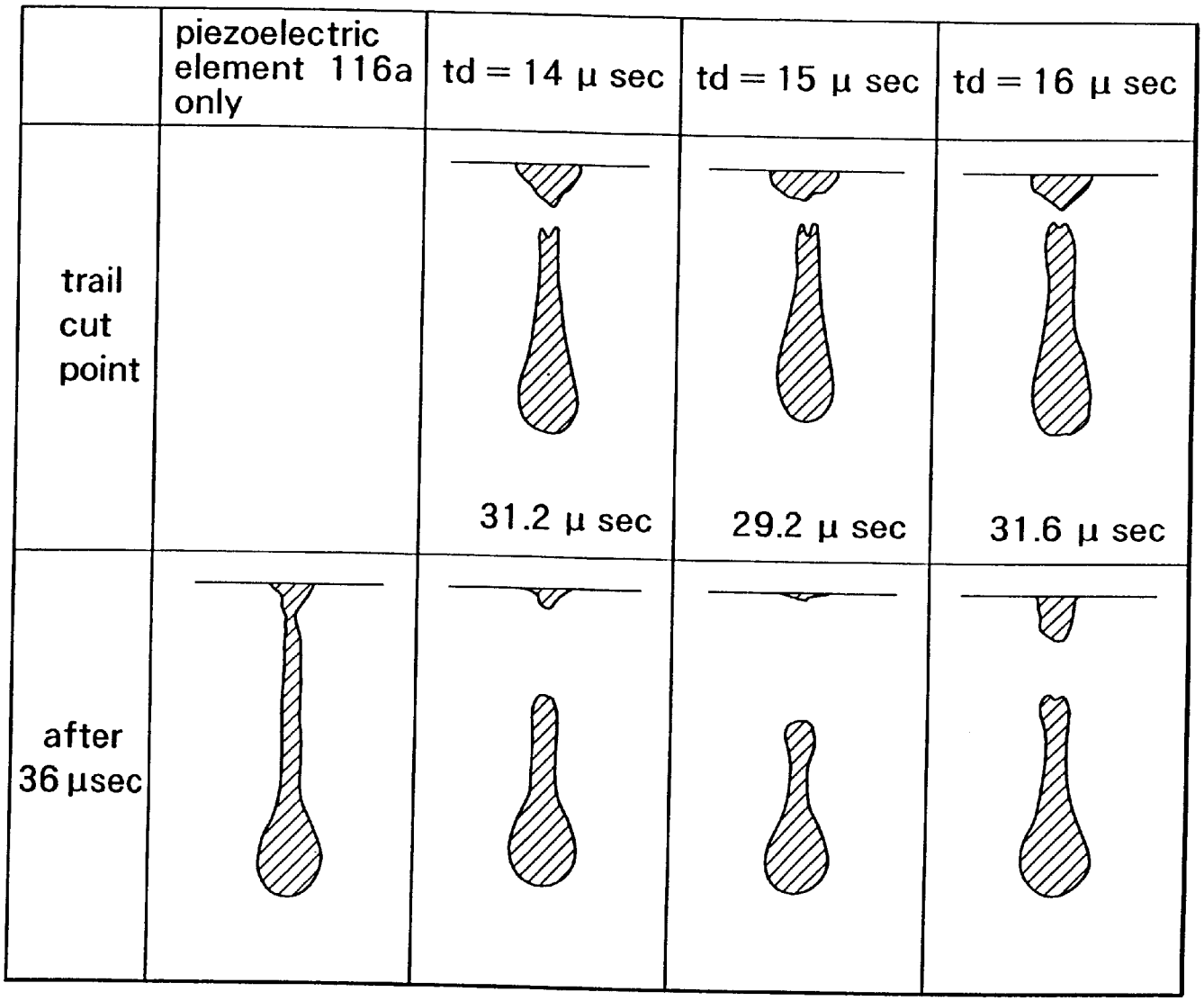
FIGS. 10A and 10B show examples of states of ink droplets ejected by the drive signal waveforms shown in FIG. 7A and FIG. 7B FIG. 11A and FIG. 11B show examples of drive signals outputted from the head controller of an ink-jet printer of a second embodiment of the invention.

FIG. 10A and FIG. 10B show the states of ink droplet ejection wherein delay time td is changed to various values. FIG. 10A shows the changes of cutting points of the trails of ink droplets wherein delay time td is set to 14, 15 and 16 μsec, respectively. FIG. 10B shows the states of ink droplets 36 μsec after ejection start point 'te' wherein the piezoelectric element 116*a* is only shifted by the drive signal 21*a* and delay time td is set to 14, 15 and 16 μsec, respectively. The thickness of the piezoelectric elements 116*a* and 116*b* is 25 μm and the thickness of the oscillation plate 113 is 25 μm. The time and voltage parameters of the drive signals 21*a* and 21*b* shown in FIG. 7A and FIG. 7B are determined as follows. The unit of each time parameter is 'μsec.' The unit of each voltage parameter is 'volt.'

$\tau 1=30$, $\tau 2=10$;

$t1=9$, $t2=2$, $t3=4$, $t4=20$, $t5=8$, $t6=17$, $t7=4$, $t8=20$, $t9=8$;

td=15;

Vp=35, Va=30, Vb=30.

As shown in FIG. 10A, the points of cutting the ink droplets wherein delay time td is set to 14, 15 and 16 μsec, respectively, are the points each after a lapse of 31.2, 29.2 and 31.6 μsec, respectively, from ejection starting point 'te'. In the states after a lapse of 36 μsec from ejection starting point 'te', as shown in FIG. 10B, the trail of the ink droplet is cut earlier in any of the cases wherein delay time td is set to 14, 15 and 16 μsec, respectively, than the case wherein ejection is performed with the piezoelectric element 116*a* only. In particular, the droplet length when delay time td is set to 15 μsec is shorter than the cases wherein delay time td is set to 14 and 16 μsec, respectively.

As thus described, the point of cutting the ink droplet trail is advanced by applying the drive signal 2 lb to the piezoelectric element 116*b*. Generation of satellite droplets is thereby suppressed. In particular, the droplet trail is cut at the earliest point wherein delay time td is set to 15 μsec and generation of satellite droplets is most efficiently suppressed. In the embodiment the delay time of 15 μsec is nearly equal to the time required for the piezoelectric element 116*a* to reach the maximum displacement point from the point at which the displacement of the piezoelectric element 116*a* is started. That is, generation of satellite droplets is most efficiently suppressed by performing control such that the piezoelectric element 116*b* is started to be shifted by raising auxiliary voltage Vb of the drive signal 21*b* at the point when the displacement amount of the piezoelectric element 116*a* is made maximum by the ejection voltage Va of the drive signal 21*a*.

According to the embodiment described so far, the two piezoelectric elements 116*a* and 116*b* are provided for each ink chamber 114 corresponding to each nozzle. Having started ink droplet ejection by the one piezoelectric element 116*a* , the ink chamber 114 is further contracted by effecting displacement of the other piezoelectric element 116*b* while the ink chamber 114 is contracted by the displacement of the piezoelectric element 116*a*. As a result, the ink droplet trail is cut at an early stage and generation of satellite droplets is suppressed. In particular, generation of satellite droplets is most efficiently suppressed by starting the displacement of the piezoelectric element 116*b* at the point when the amount of displacement of the piezoelectric element 116*a* is at a maximum.

The invention is not limited to the embodiment wherein the displacement of the piezoelectric element 116*b* is started at the point when the amount of displacement of the piezoelectric element 116*a* is at a maximum as shown in FIG. 9A to FIG. 9D. Although the embodiment is preferable, similar effects will be achieved by starting the displacement of the piezoelectric element 116*b* at any time when the ink chamber 114 is contracted (that is, between points E and H in FIG. 9B).

[Second Embodiment]

Another embodiment of the invention will now be described.

Figures 11A, 11B:
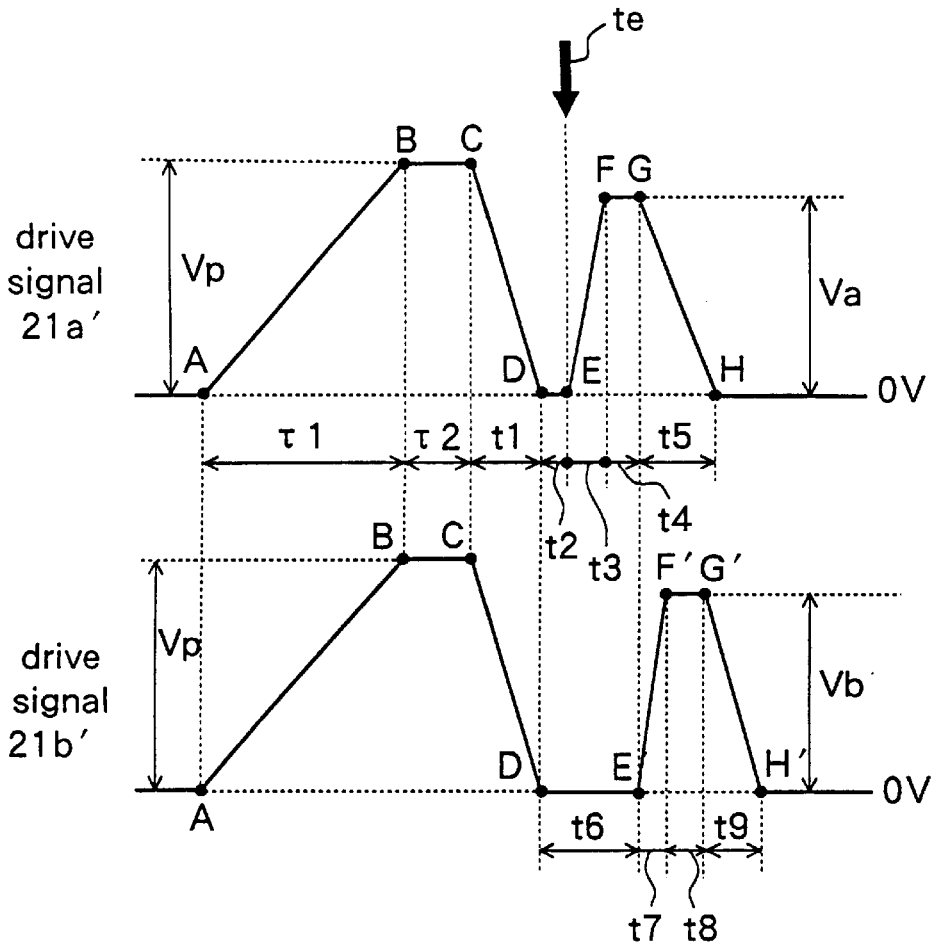

In the ink-jet printer of the second embodiment of the invention for preventing generation of satellite droplets, as shown in FIG, 11A and FIG. 11B, a drive signal 21*a*' outputted from the head controller 14 is raised from the reference voltage of 0 V to ejection voltage Va at point E (ejection start point 'te') so as to shift the piezoelectric element 116*a* in the direction of contracting the ink chamber. Then, the operation is started for shifting the piezoelectric element 116*a* in the direction of expanding the ink chamber 114 at point G. At the same time, a drive signal 21*b*' outputted from the head controller 14 is raised from the reference voltage of 0 V to auxiliary voltage Vb so as to shift the piezoelectric element 116*b* in the direction of contracting the ink chamber with timing nearly parallel with the operation of displacing the piezoelectric element 116*a* in the direction of expanding the ink chamber. The basic configuration of the ink-jet printer of the second embodiment is similar to that of the first embodiment shown in FIG. 4 to FIG. 6 and description thereof is omitted.

FIG. 11A and FIG. 11B show the waveforms of the drive signals 21*a*' and 21*b*' of one cycle (T) that correspond to FIG. 7A and FIG. 7B of the foregoing first embodiment. Since the drive signals 21*a*' and 21*b*' have the waveform patterns similar to those of the drive signals 21*a* and 21*b* shown in FIG. 7A and FIG. 7B, like numerals are assigned to the corresponding voltage changing points, voltage parameters and time parameters for convenience of description.

The drive signal 21*a*' is a drive signal for generating a pressure for ejecting an ink droplet. The voltage of the drive signal 21*a*' includes retraction voltage Vp and ejection voltage Va besides the reference voltage of 0 V. The significance of the drive signal 21*a*' is similar to that of the drive signal 21*a* of the foregoing embodiment described with reference to FIG. 8A to FIG. 8C and description thereof is omitted. The drive signal 21*b*' is an auxiliary drive signal for generating a pressure for suppressing satellite droplets when an ink droplet is ejected. The voltage of the drive signal 21*b*' includes retraction voltage Vp and auxiliary voltage Vb besides the reference voltage of 0 V. The pair of the drive signals 21*a*' and 21*b*' are appropriately switched to another pair by the head controller 14 between the ejection cycles and supplied to the corresponding nozzle. In the second embodiment, too, time t2 required for the second step is less than the time required for the meniscus retracted in the first step to reach the nozzle edge. Ejection voltage Va in the third step falls within the range that allows ink droplet ejection.

Referring to FIG. 11A and FIG. 11B, the waveform of the drive signal 21*b*' will be further described in detail. In the embodiment, the section from A to D of the drive signal 21*b*' is similar to that of the waveform of the drive signal 21*a*'. Time t6 required for period DE' during which the voltage of 0 V is maintained is equal to period DG (=t2+t3+t4) of the drive signal 21*a*'. The drive signal 21*b*' starts rising from the reference voltage of 0 V to auxiliary voltage Vb at point G (=point E') at which the drive signal 21*a*' starts falling from ejection voltage Va to the reference voltage of 0V As thus described, one of the features of the invention is that the drive signal 21*b*' is raised so as to shift the piezoelectric element 116*b* in the direction of contracting the ink chamber in parallel with having the drive signal 21*a*' fall so as to shift the piezoelectric element 116*a* in the direction of expanding the ink chamber. This feature will be described below.

Referring to FIG. 11A and FIG. 11B and FIG. 12A to FIG. 12D, the operation specific to the second embodiment will now be described. FIG. 12A to FIG. 12D show the relationship between changes of voltage waveforms of the drive signals 21*a*' and 21*b*' and displacements of the piezoelectric elements 116*a* and 116*b,* which correspond to FIG. 9A to FIG. 9D of the foregoing first embodiment.

Figures 12A, 12B, 12C, 12D:
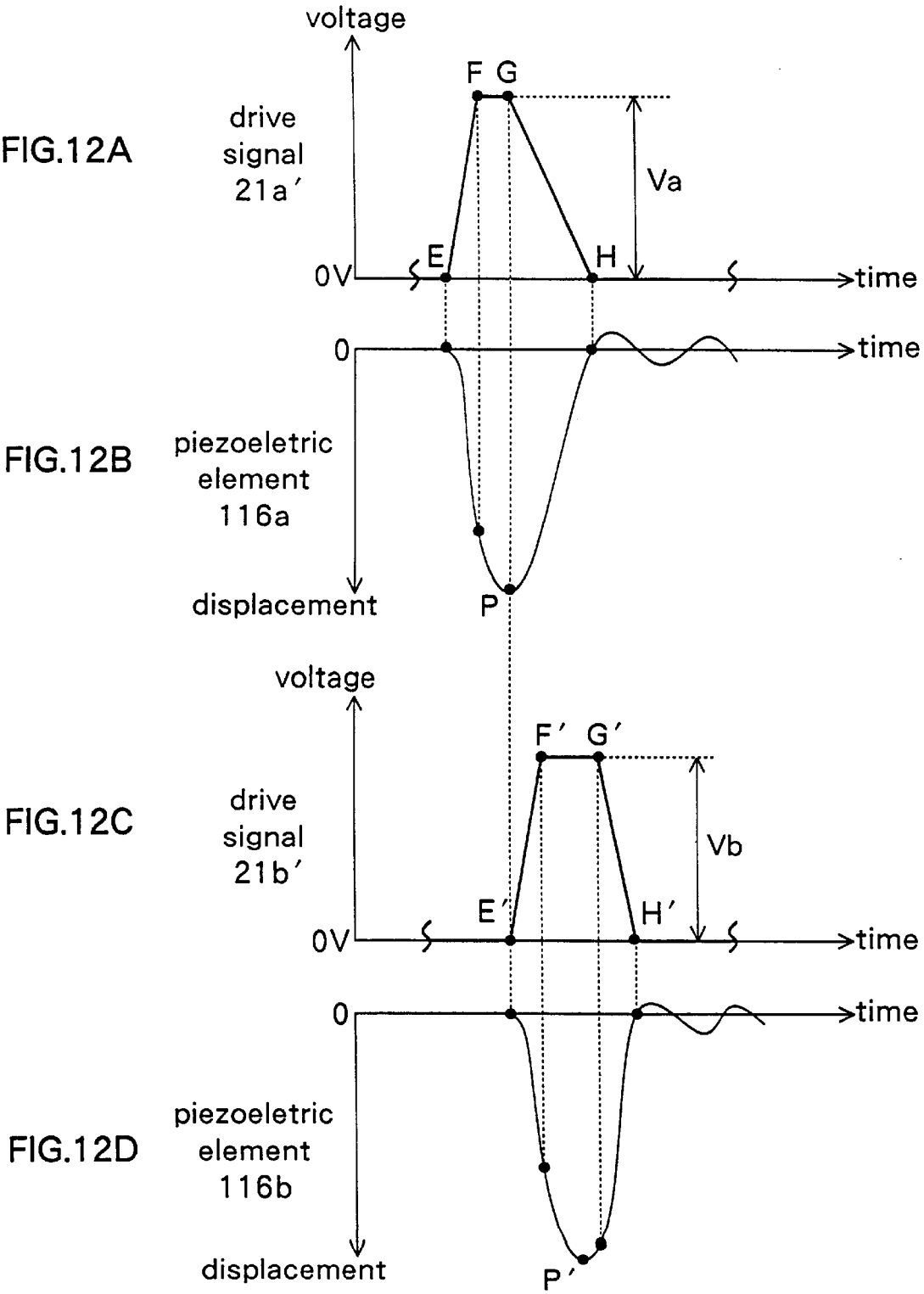
FIG. 12A to FIG. 12D show the relationship among the waveforms of the drive signals shown in FIG. 11A and FIG. 11B and the displacement amounts of the piezoelectric elements.

As shown in FIG. 12A and FIG. 12B, the piezoelectric element 116*a* is shifted in the direction of contracting the ink chamber with an increase in voltage of the drive signal 21*a*' started from point E. The amount of displacement of the piezoelectric element 116*a* reaches a maximum at point P that overruns point F at which the voltage reaches ejection voltage Va by an inertial force. The ink chamber 114 is most contracted at point P. The drive signal 21*a*' starts to fall at point P (point G in FIG. 12A) and reaches the reference voltage of 0 V at point H. The piezoelectric element 116*a* is thereby shifted in the direction of expanding the ink chamber and returns to the initial state. As shown in FIG. 12C and FIG. 12D, the drive signal 21*b*' starts to rise from the reference voltage of 0 V to auxiliary voltage Vb at point E' equal to point G at which the drive signal 21*a*' starts to fall. The piezoelectric element 116*b* is thereby shifted in the direction of contracting the ink chamber 114. The amount of displacement of the piezoelectric element 116*b* reaches maximum by an inertial force as described above at point P' that overruns point F' at which the voltage reaches ejection voltage Vb.

In the embodiment as thus described, the piezoelectric element 116*b* is shifted from the state of no displacement to the direction of contracting the ink chamber in parallel with the piezoelectric element 116*a* being shifted to the direction of expanding the ink chamber. That is, displacements of the piezoelectric elements 116*a* and 116*b* take place in the directions opposite to each other in a parallel manner.

The piezoelectric element 116*a* to which ejection voltage Va of the drive signal 21*a* is applied is shifted in the direction of contracting the ink chamber so as to generate a pressure in the ink chamber 114. Ink is ejected out of the nozzle 118 by the pressure. At this point the ink ejected out of the nozzle 118 is trailing and takes a columnar form. Next, the piezoelectric element 116*a* starts to be shifted in the direction of expanding the ink chamber, the trailing end of ink is retracted and becomes thin. At point P (point E') the piezoelectric element 116*b* is shifted in the direction of contracting the ink chamber so as to generate another pressure in the ink chamber 114. The ink column is then extruded by the pressure and discontinuity results in the ink flow. The ink column is thereby cut in an earlier stage and the trail of the ink column is prevented from extending. Consequently, generation of satellite droplets is suppressed.

At point H, the displacement of the piezoelectric element 116*a* returns to zero and then intrinsic oscillations are effected in the piezoelectric element 116*a* that gradually attenuate. Similarly, the displacement of the piezoelectric element 116*b* returns to zero at point H' and then intrinsic oscillations are effected in the piezoelectric element 116*b* that gradually attenuate.

A specific example will now be described. The thickness of the piezoelectric elements 116*a* and 116*b* is 25 $\mu$m and the thickness of the oscillation plate 113 is 25 $\mu$m. The time and voltage parameters of the drive signals 21*a*' and 21*b*' shown in FIG. 11A and FIG. 11B are determined as follows. The unit of each time parameter is '$\mu$sec.' The unit of each voltage parameter is 'volt.'

$\tau 1$=30, $\tau 2$=10;

t1=9, t2=2, t3=2, t4=3, t5=11, t6=7, t7=2, t8=8, t9=8;

Vp=35, Va=33, Vb=30.

According to the embodiment described so far, the two piezoelectric elements 116*a* and 116*b* are provided for each ink chamber 114 corresponding to each nozzle. Ink droplet ejection is started by shifting the one piezoelectric element 116*a* in the direction of contracting the ink chamber. The other piezoelectric element 116*b* is then shifted from the state of displacement of zero to the direction of contracting the ink chamber in parallel with shifting the piezoelectric element 116*a* to the direction of expanding the ink chamber. As a result, the ink droplet trail is cut at an early stage and generation of satellite droplets is thereby suppressed. In particular, generation of satellite droplets is more efficiently suppressed by having the piezoelectric element 116*a* start to return (start to be shifted in the direction of expanding the ink chamber) at or near the point when the amount of displacement of the piezoelectric element 116*a* is at a maximum in the direction of contracting the ink chamber.

The invention is not limited to the embodiment wherein point G at which the piezoelectric element 116*a* starts to shift in the direction of expanding the ink chamber coincides with point E' at which the piezoelectric element 116*b* starts to shift in the direction of contracting the ink chamber. Timing may be determined so that the piezoelectric element 116*b* shifts in the direction of contracting the ink chamber in nearly parallel with the piezoelectric element 116*a* shifting in the direction of expanding the ink chamber. The condition for achieving the state is that the time parameters shown in FIG. 11A and FIG. 11B satisfy expressions (1) and (2) below.

$$t2+t3+t4<t6+t7 \quad (1)$$

$$t2+t3+t4+t5>t6 \quad (2)$$

The invention is not limited to the embodiment wherein the piezoelectric element 116*a* starts to return to the initial state (in the direction of expanding the ink chamber) at the point when the amount of displacement of the piezoelectric element 116*a* itself is at a maximum. Alternatively, the piezoelectric element 116*a* may start to return to the initial state at any other point. However, the ink droplet trail is made thin at an earlier stage if the piezoelectric element 116*a* starts to return to the initial state at or near the point when the amount of displacement of the piezoelectric element 116*a* is at a maximum. The droplet size is thereby made smaller.

[Third Embodiment]

Still another embodiment of the invention will now be described.

Figures 13A, 13B:
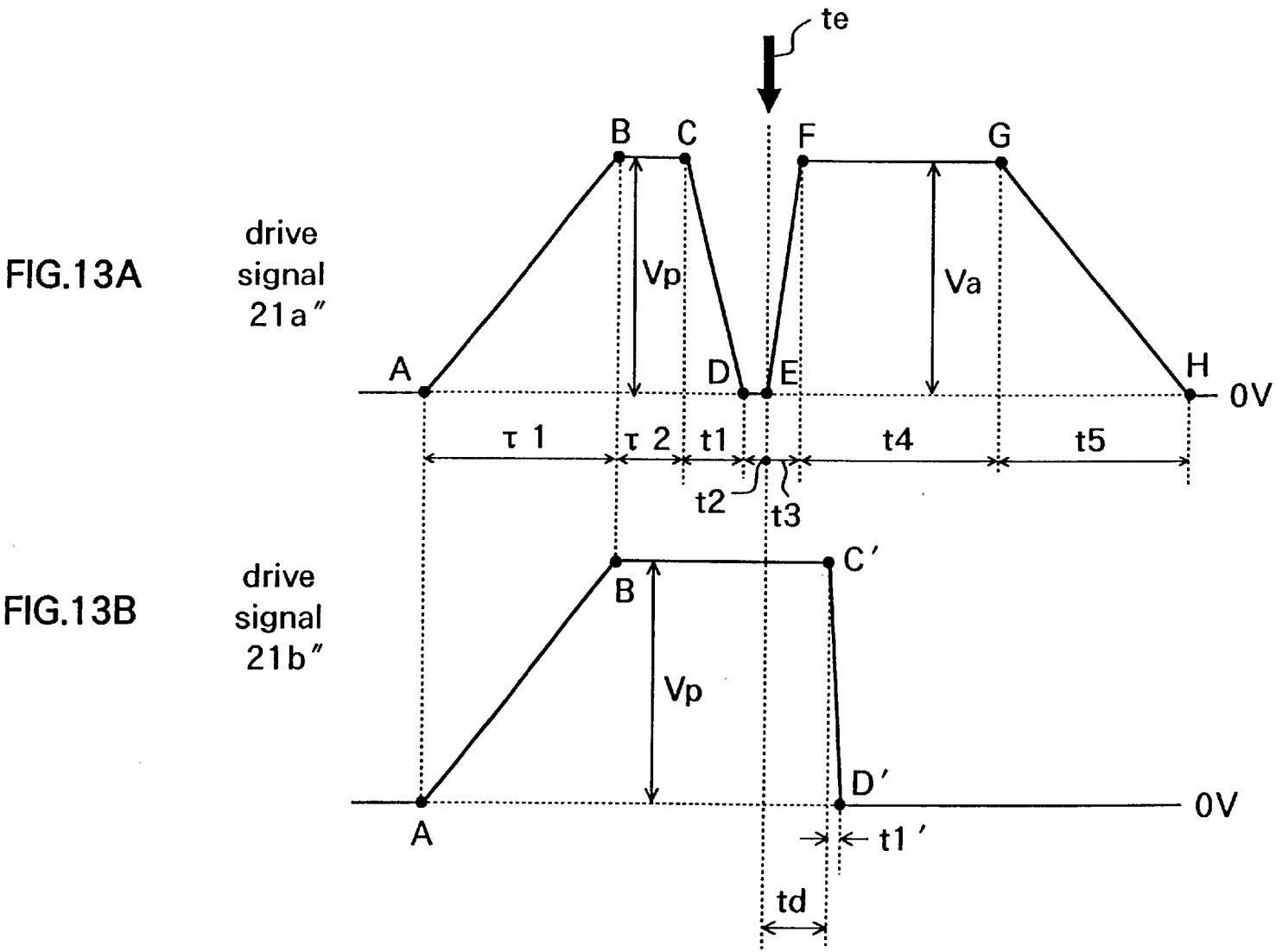
FIG. 13A and FIG. 13B show examples of drive signals outputted from the head controller of an ink-jet printer of a third embodiment of the invention.

In the ink-jet printer of the third embodiment of the invention for preventing generation of satellite droplets, as shown in FIG. 13A and FIG. 13B, a drive signal 21*b*" outputted from the head controller 14 is maintained at retraction voltage Vp in advance so as to keep the piezoelectric element 116*a* contracted. In this state, the first to third steps of the piezoelectric element 116*a* (FIG. 8A to FIG. 8C) are performed by means of a drive signal 21*a*" outputted from the head controller 14. In the state wherein the piezoelectric element 116*a* is shifted in the direction of contracting the ink chamber by means of the drive signal 21*a*" after the third step, the drive signal 21*b*" is made to fall so as to shift the piezoelectric element 116*b* in the direction of expanding the ink chamber. The basic configuration of the ink-jet printer of the second embodiment is similar to that of the first embodiment shown in FIG. 4 to FIG. 6 and description thereof is omitted.

FIG. 13A and FIG. 13B show the waveforms of the drive signals 21*a*" and 21*b*" of one cycle (T) that correspond to FIG. 7A and FIG. 7B of the foregoing first embodiment. Since the drive signal 21*a*" has the waveform pattern similar to that of the drive signal 21*a* shown in FIG. 7A and the drive signal 21*b*" has the waveform pattern similar to the first half of the waveform of the drive signal 21*b* shown in FIG. 7B, like numerals are assigned to the corresponding voltage changing points, voltage parameters and time parameters for convenience of description.

The drive signal 21*a*" is a drive signal for generating a pressure for ejecting an ink droplet. The voltage of the drive signal 21*a*" includes retraction voltage Vp and ejection voltage Va besides the reference voltage of 0 V. The significance of the drive signal 21*a*" is similar to that of the drive signal 21*a* of the foregoing embodiment described with reference to FIG. 8A to FIG. 8C and description thereof is omitted. The drive signal 21*b*" is an auxiliary drive signal for generating a pressure for suppressing satellite droplets when an ink droplet is ejected. The voltage of the drive signal 21*b*" includes the reference voltage of 0 V and retraction voltage Vp. The pair of the drive signals 21*a*" and 21*b*" are appropriately switched to another pair by the head controller 14 between the ejection cycles and supplied to the corresponding nozzle. In the third embodiment, too, time t2 required for the second step is less than the time required for the meniscus retracted in the first step to reach the nozzle edge. Ejection voltage Va in the third step falls within the range that allows ink droplet ejection.

Referring to FIG. 13A and FIG. 13B, the waveform of the drive signal 21*b*" will be further described in detail. In the embodiment the drive signal 21*b*" changes from the reference voltage of 0 V to retraction voltage Vp in section AB like the drive signal 21*a*". Retraction voltage Vp is maintained until specific point C' after point F at which the drive signal 21*a*" reaches ejection voltage Va. At point C' retraction voltage Vp abruptly falls to the reference voltage of 0 V. In FIG. 13A and FIG. 13B time 'td' is from ejection start point 'te' of the drive signal 21*a*" (that is, point E at which the drive signal 21*a*" starts rising from the reference voltage of 0V to ejection voltage Va) until point C' at which the drive signal 21*b*" starts falling from retraction voltage Vp to the reference voltage of 0V. Time required for section BC' during which retraction voltage Vp is maintained is expressed as t1+t2+td where td>t3. In FIG. 13B time required for section C'D' during which the drive signal 21*b*" changes from retraction voltage Vp to the reference voltage of 0V is shown as t1'. One of the features of the invention is that delay time td is appropriately determined.

Referring to FIG. 13A and FIG. 13B to FIGS. 15A and 15B, the operation specific to the third embodiment will now be described. FIG. 14A to FIG. 14D show the relationship between changes of voltage waveforms fo the drive signals 21*a*" and 21*b*" and displacements of the piezoelectric elements 116*a* and 116*b*, which correspond to FIG. 9A to FIG. 9D of the foregoing first embodiment.

Figures 14A, 14B, 14C, 14D:
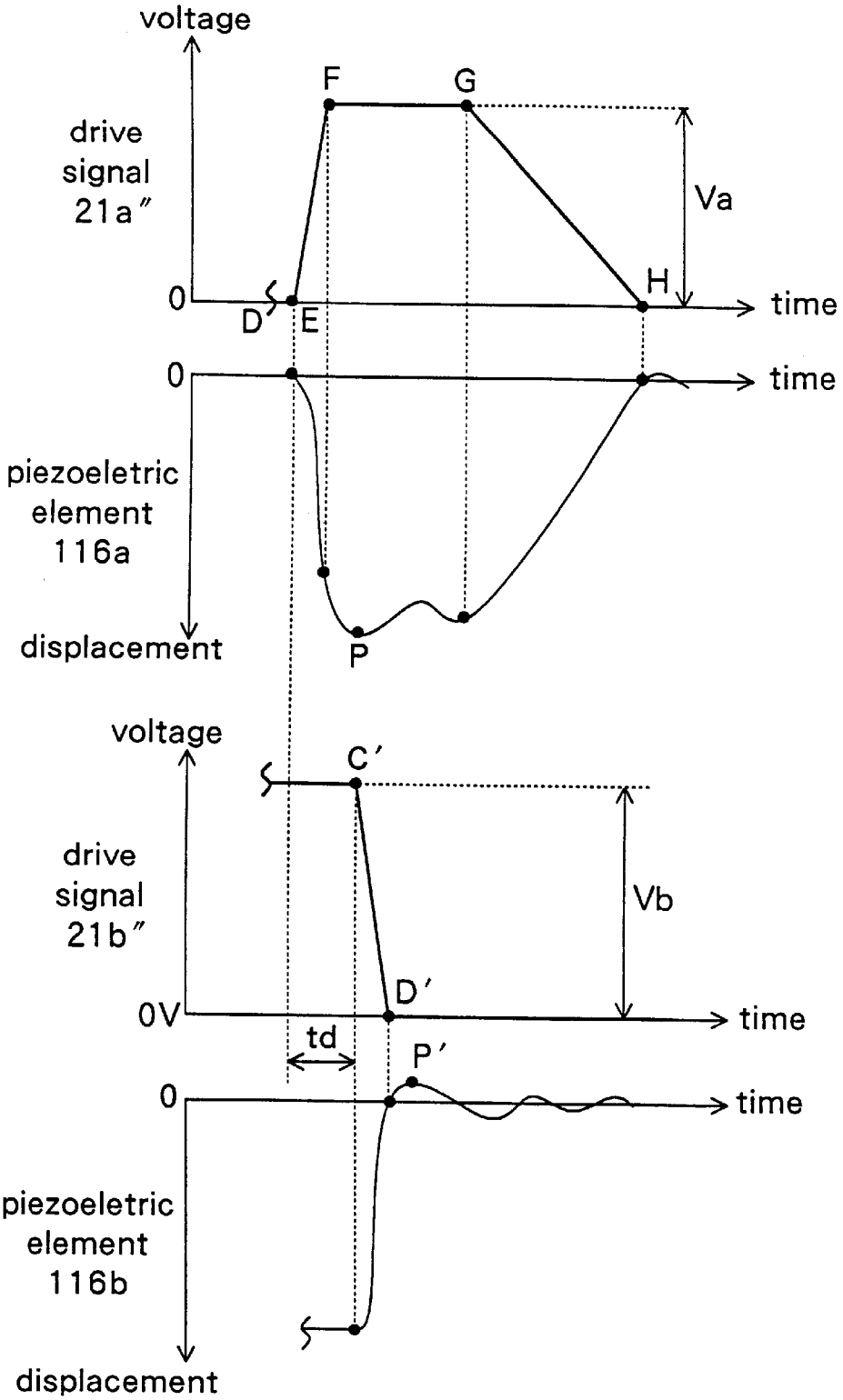
FIG. 14A to FIG. 14D show the relationship among the waveforms of the drive signals shown in FIG. 13A and FIG. 13B and the displacement amounts of the piezoelectric elements.

As shown in FIG. 14C and FIG. 14D, the piezoelectric element 116*b* closer to the nozzle is maintained in the state shifted in the direction of contracting the ink chamber by maintaining the drive signal 21*b*" at retraction voltage Vp in advance. In this state, as shown in FIG. 14A and FIG. 14B, the piezoelectric element 116*a* closer to the duct starts to shift in the direction of contracting the ink chamber at point E with an increase in voltage of the drive signal 21*a*". The amount of displacement of the piezoelectric element 116*a* reaches a maximum by an inertial force at point P that overruns point F at which the voltage reaches ejection voltage Va. As shown in FIG. 14C and FIG. 14D, the drive signal 21*b*" starts to fall from retraction voltage Vp to the reference voltage of 0 V at specific point C' after point F at which the drive signal 21*a*" reaches ejection voltage Va (that is, the point after a lapse of time 'td' from ejection start point 'tc' [=point E]). The drive signal 21*b*" then reaches the reference voltage of 0 V at point D'. The piezoelectric element 116*b* is thereby abruptly shifted in the direction of expanding the ink chamber.

As shown in FIG. 14A and FIG. 14B, the piezoelectric element 116*a* to which ejection voltage Va of the drive signal 21*a*" is applied is shifted in the direction of contracting the ink chamber so as to generate a pressure in the ink chamber 114. Ink is ejected out of the nozzle 118 by the pressure. At this point the ink ejected out of the nozzle 118 is trailing and takes a columnar form. On the other hand, the voltage applied to the piezoelectric element 116*b* falls from retraction voltage Vp to the reference voltage of 0 V at point C' after a lapse of time 'td' since the piezoelectric element 116*a* starts shifting. The piezoelectric element 116*b* is thereby abruptly shifted in the direction of expanding the ink chamber so as to generate a negative pressure in the ink chamber 114. The trailing end of the ink column being extruded through the nozzle 118 is pulled back by the negative pressure. Discontinuity thereby results in the ink flow and the ink column is cut between the tip and the trail thereof The ink column trail is thus prevented from extending and generation of satellite droplets is suppressed.

While ejection voltage Va is maintained, intrinsic oscillations are effected in the piezoelectric element 116*a*. When the drive signal 21*a*" changes from ejection voltage Va at point G to the reference voltage of 0 V at point H, the displacement of the piezoelectric element 116*a* returns to zero and then intrinsic oscillations are effected in the piezoelectric element 116*a* that gradually attenuate. After point D' at which the voltage reaches the reference voltage of 0 V, intrinsic oscillations around the intended displacement position are effected in the piezoelectric element 116*b* that gradually attenuate.

Figures 15A, 15B:
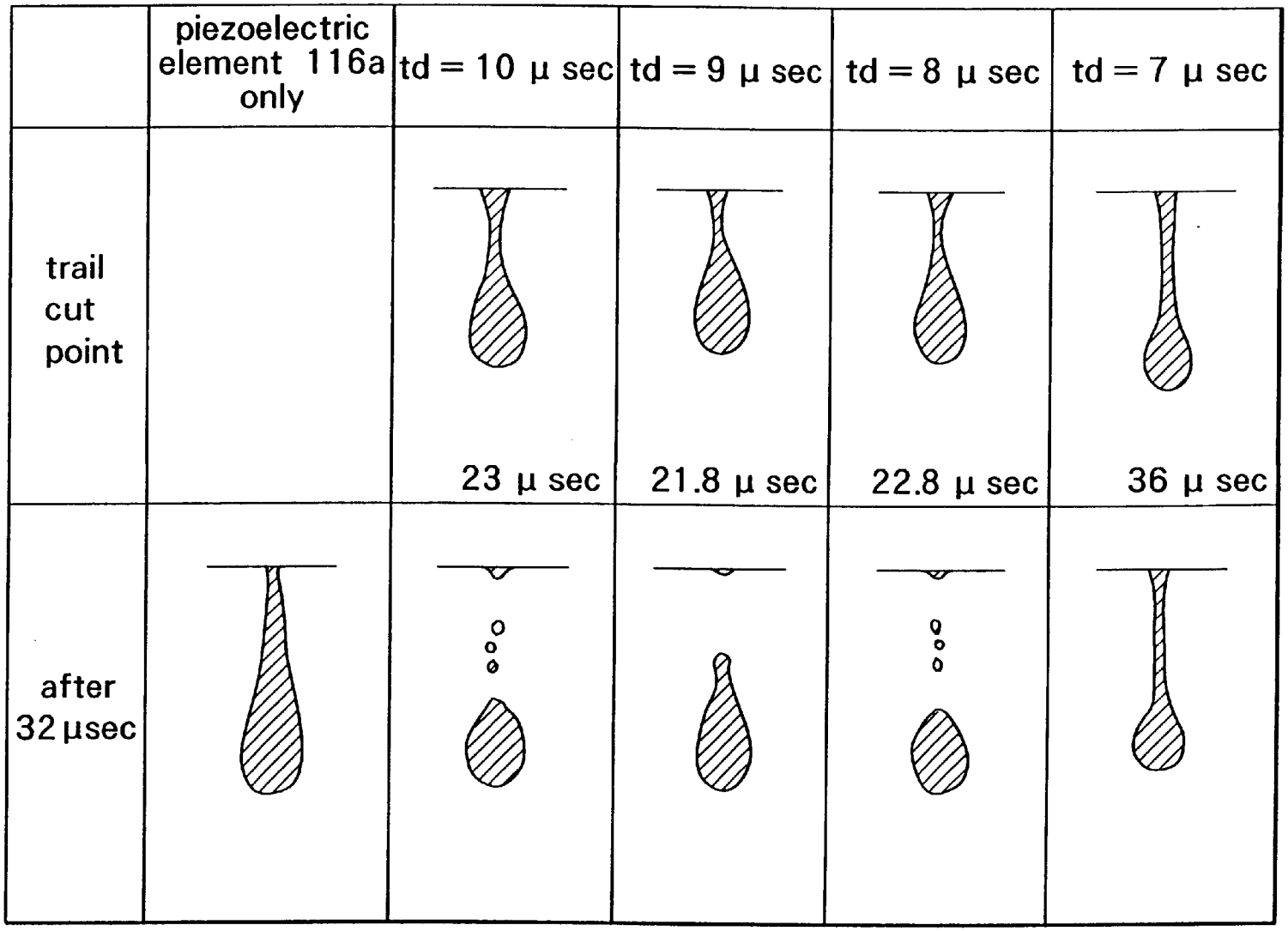
FIGS. 15A and 15B show examples of states of ink droplets ejected by the drive signal waveforms shown in FIG. 13A and FIG. 13B.

FIG. 15A and FIG. 15B show the states of ink droplet ejection wherein delay time 'td' between ejection start point 'te' (point E) and point C' at which the drive signal 21*b*" is changed to various values. FIG. 15A shows the changes of points at which the trails of ink droplets are cut wherein delay time td is set to 10, 9, 8 and 7 μsec, respectively. FIG. 15B shows the states of ink droplets 32 μsec after ejection start point 'te' wherein the piezoelectric element 116*a* is only shifted by the drive signal 21*a*" and delay time td is set to 10, 9, 8 and 7 μsec, respectively. The thickness of the piezoelectric elements 116*a* and 116*b* is 25 μm and the thickness of the oscillation plate 113 is 25 μm. The time and voltage parameters of the drive signals 21*a*" and 21*b*" shown in FIG. 13A and FIG. 13B are determined as follows. The unit of each time parameter is 'μsec.' The unit of each voltage parameter is 'volt.'

$\tau 1=30$, $\tau 2=10$;

$t1=9$, $t2=2$, $t3=5$, $t4=50$, $t5=50$, $t6=1$;

$td=9$;

$Vp=35$, $Va=35$, $Vb=35$.

As shown in FIG. 15A, the points of cutting the ink droplets wherein delay time td is set to 10, 9, 8 and 7 μsec, respectively, are the points each after a lapse of 23, 21.8, 22.8 and 36 μsec, respectively, from ejection start point 'te'. In the states after a lapse of 32 μsec from ejection start point 'te', as shown in FIG. 15B, the trail of the ink droplet is cut earlier in any of the cases wherein delay time td is set to 10, 9 and 8 μsec, respectively, than the case wherein ejection is performed with the piezoelectric element 116*a* only. In particular, no satellite droplets are produced when delay time td is set to 9 μsec in contrast to the cases wherein delay time td is set to the other values. However, if delay time td is set to 7 μsec or below, the ejection pressure generated by the piezoelectric element 116*a* is cancelled out by the negative pressure generated by the piezoelectric element 116*b* and the velocity of the ink droplet ejected is reduced. In particular, no ink droplet is ejected if delay time td is set to 5 μsec.

As thus described, the point of cutting the ink droplet trail is advanced by applying the drive signal 21*b*" to the piezoelectric element 116*b*. Generation of satellite droplets is thereby suppressed. In particular, the droplet trail is cut at the earliest point if delay time td is set to 9 μsec and generation of satellite droplets is most efficiently suppressed. In the embodiment the delay time of 9 μsec is nearly equal to the time required for the piezoelectric element 116*a* to reach maximum displacement point P (FIG. 9B) from the point at which the displacement of the piezoelectric element 116*a* is started. That is, generation of satellite droplets is most efficiently suppressed by starting displacement of the piezoelectric element 116*b* in the direction of expanding the ink chamber by having the drive signal 21*b*" fall at the point when the displacement amount of the piezoelectric element 116*a* is made maximum by ejection voltage Va of the drive signal 21*a*".

According to the embodiment described so far, the two piezoelectric elements 116*a* and 116*b* are provided for each ink chamber 114 corresponding to each nozzle. The piezoelectric element 116*b* closer to the nozzle is shifted in the direction of contracting the ink chamber in advance. In this state, ink droplet ejection is started by shifting the piezoelectric element 116*a* closer to the ink feed in the direction of contracting the ink chamber. The other piezoelectric element 116*b* is then shifted in the direction of expanding the ink chamber so as to generate a negative pressure in the ink chamber 114. As a result, the ink droplet trail is cut at an early stage and generation of satellite droplets is thereby suppressed. In particular, generation of satellite droplets is most efficiently suppressed by having the piezoelectric element 116*b* started to shift in the direction of expanding the ink chamber at the point when the amount of displacement of the piezoelectric element 116*a* is maximum in the direction of contracting the ink chamber.

The invention is not limited to the embodiment wherein the piezoelectric element 116*b* starts to shift at the point when the amount of displacement of the piezoelectric element 116*a* is maximum. Although the embodiment is preferable, similar effects are achieved by starting the displacement of the piezoelectric element 116*b* at any other point after the piezoelectric element 116*a* starts shifting.

The invention is not limited to the embodiments described so far but may be practiced in still other ways.

For example, the time and voltage parameter values mentioned in the foregoing embodiments (FIG. 7A and FIG. 7B, FIG. 11A and FIG. 11B, FIG. 13A and FIG. 13B) are no more than examples and may be appropriately changed to other values. For example, although the retraction voltages of the drive signals 21*a* and 21*b* and so on are both Vp in the foregoing embodiments, the voltages may be of different values.

In the foregoing embodiments, the piezoelectric element 116*a* closer to the ink feed is used as the means for generating a pressure for ejection and the piezoelectric element 116*b* closer to the nozzle is used as the means for generating a pressure for preventing satellite droplets. Alternatively, the piezoelectric element 116*b* closer to the nozzle may be used as the means for generating a pressure for ejection and the piezoelectric element 116*a* closer to the ink feed may be used as the means for generating a pressure for preventing satellite droplets.

Although two piezoelectric elements are provided for each nozzle in the foregoing embodiments, three or more piezoelectric elements may be provided for each nozzle. These piezoelectric elements are divided into those for ejection and those for suppressing satellite droplets. The drive signals 21*a* and so on are applied to the piezoelectric elements for ejection while the drive signals 21*b* and so on are applied to the piezoelectric elements for suppressing satellite droplets. The displacement capacities of the three or more piezoelectric elements may be either equal to one another or different from one another. As a result, more delicate control is performed for suppressing satellite droplets.

Figure 16:
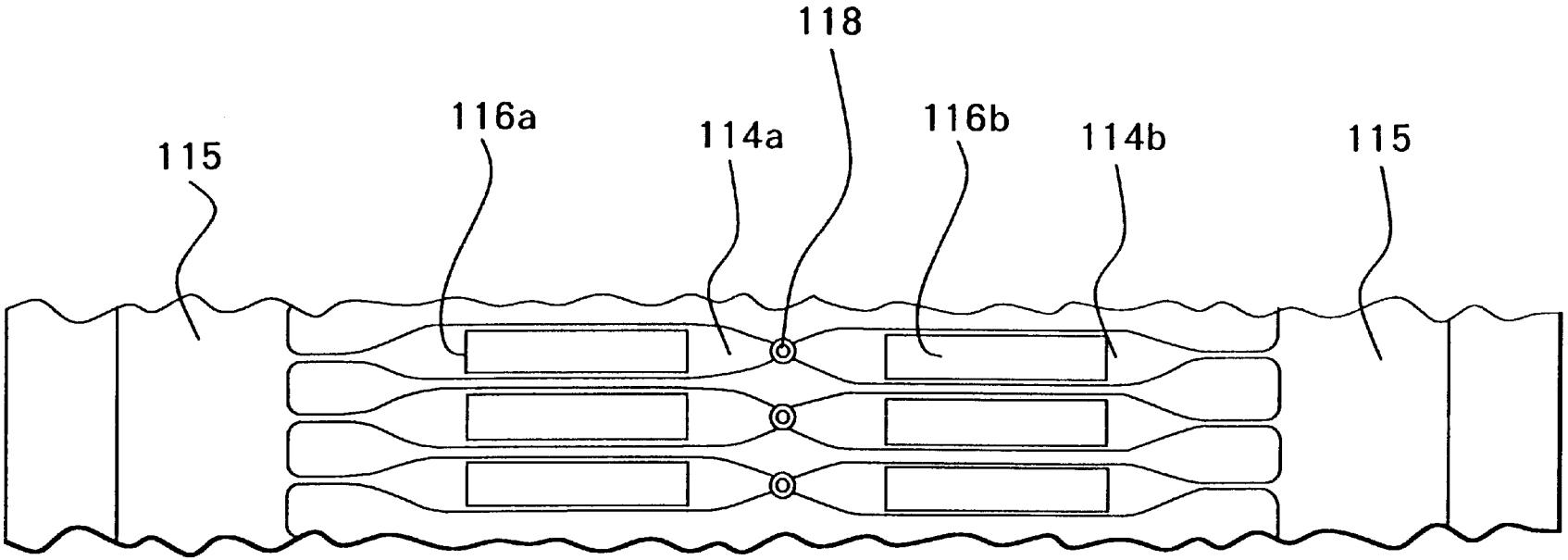
FIG. 16 is a top view of a modification example of a recording head used in the ink-jet printer of the embodiments of the invention.

In the foregoing embodiments the one ink chamber 114 is provided for the one nozzle 118 and the two piezoelectric elements 116*a* and 116*b* corresponding to the ink chamber 114 are provided. Alternatively, as shown in FIG. 16, for example, two ink chambers 114*a* and 114*b* may be provided for the one nozzle 118 and the piezoelectric elements 116*a* and 116 b each corresponding to the ink chambers 114*a* and 114*b*, respectively, may be provided. FIG. 16 is a top view of part of the recording head 11 wherein like numerals are assigned to the components similar to those shown in FIG. 5 and the oscillation plate 13 is omitted. In the configuration as shown, the behavior of the piezoelectric element 116*a* with regard to the one ink chamber 114*a* has less effect on the state of the other ink chamber 114*b*. As a result, crosstalk between the piezoelectric elements 116*a* and 116*b* is reduced and printed images of higher quality will be achieved.

Figure 17:
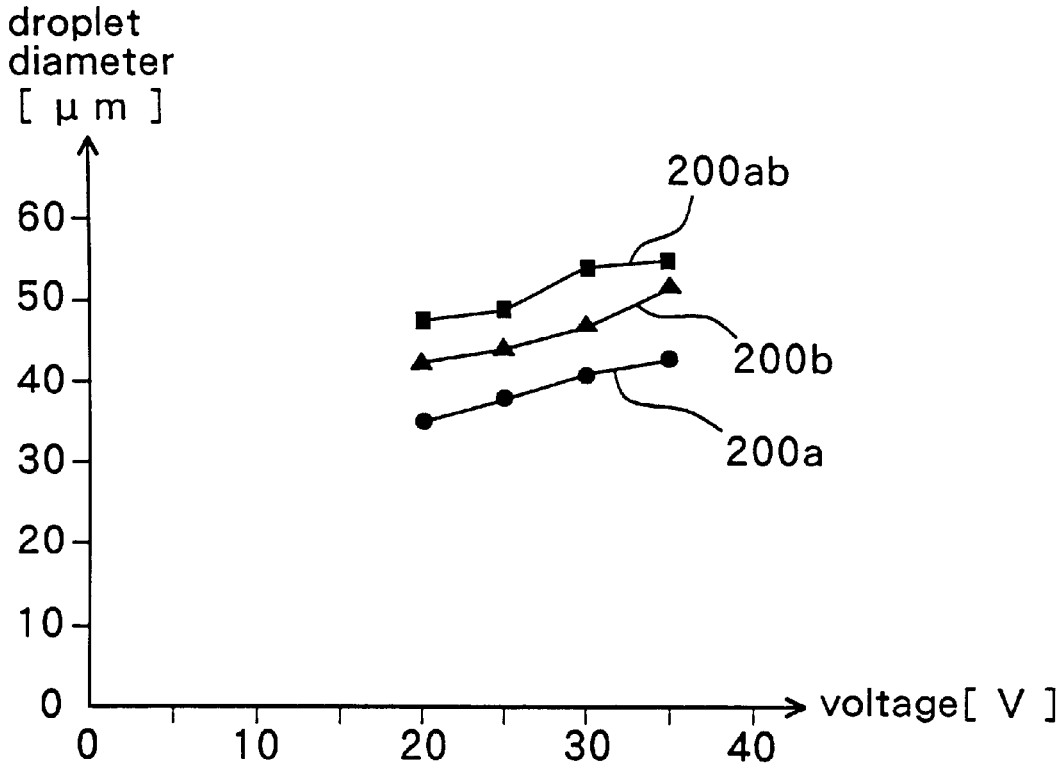
FIG. 17 is a plot for showing an example of the relationship between the ejected droplet diameter and the voltage applied to the piezoelectric element.
Figure 18:
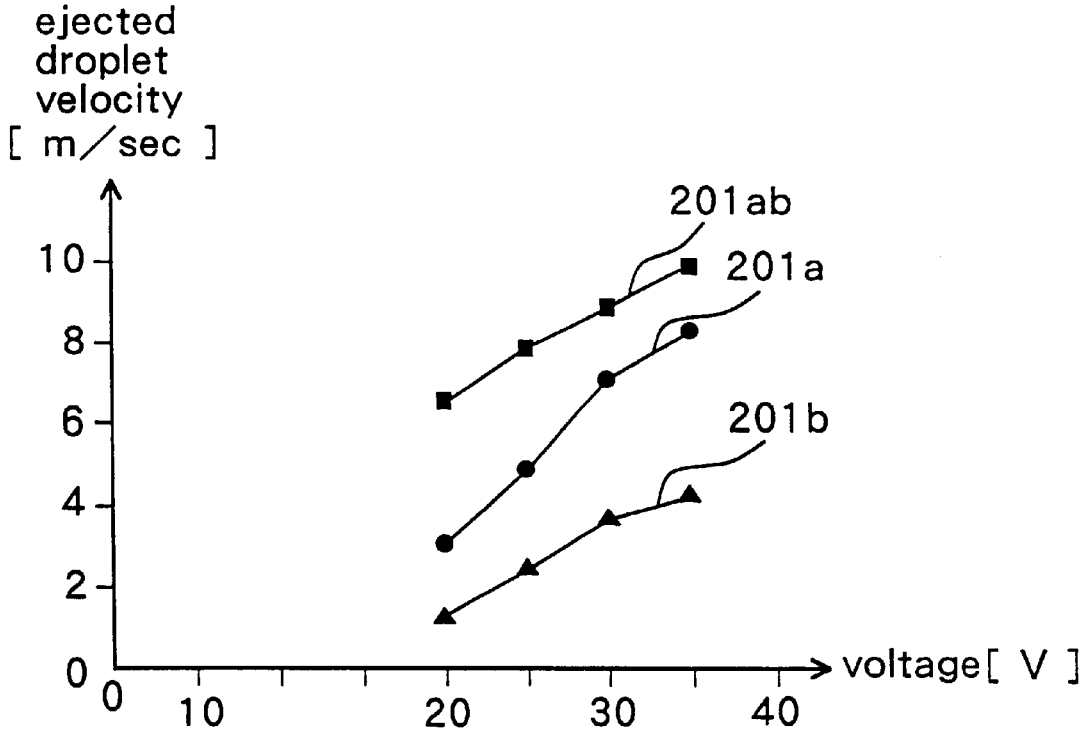
FIG. 18 is a plot for showing an example of the relationship between the ejected droplet velocity and the voltage applied to the piezoelectric element.

Referring to FIG. 17 and FIG. 18, the function specific to the ink-jet printer of the invention will now be described.

FIG. 17 shows the relationship between ink droplet diameters and applied voltages wherein ink droplet ejection is performed by either piezoelectric element 116*a* or 116*b* or both. The horizontal axis indicates applied voltages. The vertical axis indicates ink droplet diameters. A curve 200*a* with dots indicates ink droplet diameters wherein droplet ejection is performed by the piezoelectric element 116*a* away from the nozzle 118 (that is, closer to the ink feed) only. A curve 200*b* with deltas indicates ink droplet diameters wherein droplet ejection is performed by the piezoelectric element 116*b* closer to the nozzle 118 only. A curve 200*ab* with squares indicates ink droplet diameters wherein droplet ejection is performed by both piezoelectric elements 116*a* and 116*b*.

As shown, regardless of the applied voltage, the shortest droplet diameter is obtained when ejection is performed by the piezoelectric element 116*a* closer to the ink feed. The droplet diameter is longer when ejection is performed by the piezoelectric element 116*b* closer to the nozzle and still longer when ejection is performed by both piezoelectric elements 116*a* and 116*b*. That is, a smaller droplet is obtained by performing ejection by the piezoelectric element 116*a* closer to the ink feed than the piezoelectric element 116*b* closer to the nozzle.

FIG. 18 shows the relationship between velocities of ejected ink droplets and applied voltages wherein ink droplet ejection is performed by either piezoelectric element 116*a* or 116*b* or both. The horizontal axis indicates applied voltages. The vertical axis indicates velocities of ejected ink droplets. A curve 201*a* with dots indicates ejected droplet velocities wherein droplet ejection is performed by the piezoelectric element 116*a* closer to the ink feed only. A curve 201*a* with deltas indicates ejected droplet velocities wherein droplet ejection is performed by the piezoelectric element 116*b* closer to the nozzle 118 only. A curve 201*ab* with squares indicates ejected droplet velocities wherein droplet ejection is performed by both piezoelectric elements 116*a* and 116*b*.

As shown, regardless of the applied voltage, the highest droplet velocity is obtained when ejection is performed by both piezoelectric elements 116*a* and 116*b*. The velocity is lower when ejection is performed by the piezoelectric element 116*a* closer to the ink feed and still lower when ejection is performed by the piezoelectric element 116*b* closer to the nozzle. That is, a higher droplet velocity is obtained by performing ejection by the piezoelectric element 116*a* closer to the ink feed than the piezoelectric element 116*b* closer to the nozzle.

Based on the results, the piezoelectric element 116*a* away from the nozzle is used for droplet ejection while the piezoelectric element 116*b* closer to the nozzle is used for suppressing satellite droplets. That is a reason why, the drive signal 21*a* is applied to the piezoelectric element 116*a* and the drive signal 21*b* to the piezoelectric element 116*b*. Generation of satellite droplets is thereby suppressed, the droplet size is reduced and the ejected droplet velocity is increased.

The invention is not limited to the embodiments described so far but may be practiced in still other ways. For example, although the piezoelectric element 116*b* as the means for generating an auxiliary pressure is used for suppressing satellite droplets, the invention may be applied to a case wherein the means for generating an auxiliary pressure is used for any other purpose.

For example, the inventors of after ink after ink droplet ejection is performed with the piezoelectric element for ejection the meniscus position exhibits great fluctuations (long-period residual oscillations) even after the short-period oscillations of the piezoelectric element for ejection almost disappear. The auxiliary piezoelectric element can be driven with appropriate timing in order to suppress such residual oscillations of the meniscus. In such a case, too, a higher velocity of an ejected ink droplet and a smaller droplet size are both achieved as well as suppression of residual oscillations by placing the auxiliary piezoelectric element closer to the nozzle and the piezoelectric element for ejection away from the nozzle.

There is proposed an ink-jet printer that allows smooth ink droplet ejection through a nozzle by giving preliminary small oscillations to the meniscus by the auxiliary piezoelectric element before ejection when droplet ejection is first performed after power-up of the printer or when a droplet is to be ejected through a nozzle that has not been used for ejection for a long time. In such a case, too, a higher velocity of an ejected ink droplet and a smaller droplet size are both achieved as well as smooth droplet ejection by placing the auxiliary piezoelectric element closer to the nozzle and the piezoelectric element for ejection away from the nozzle.

[Fourth Embodiment]

Another embodiment of the invention will now be described.

In the fourth embodiment, the piezoelectric elements 116*a* and 116*b* (FIG. 5 and FIG. 6) have ink drive capacities different from each other in response to the same applied voltage. The ink drive capacity means the capacity for changing the volume of the ink chamber 114. To be specific, the piezoelectric element 116*a* has the ink drive capacity greater than the piezoelectric element 116*b*. The piezoelectric elements 116*a*. and 116*b* are therefore made of the same material and have the same thickness while the piezoelectric element 116*a* has a surface area greater than the piezoelectric element 116*b*. As a result, a change in volume of the ink chamber 114 effected by the piezoelectric element 116*a* is greater than a change effected by the piezoelectric element 116*b* in response to the same applied voltage. Consequently, as long as the ejection voltage (described below) applied is equal, a shorter ink droplet diameter is achieved when the voltage is applied to the piezoelectric element 116*b* compared to the piezoelectric element 116*a*. The surface area ratio between the elements 116*a* and 116*b* may be two to one. Alternatively, the ratio may be any other ratio. The piezoelectric elements 116*a* and 116*b* correspond to an 'ejection energy generating means' of the invention.

Figure 19:
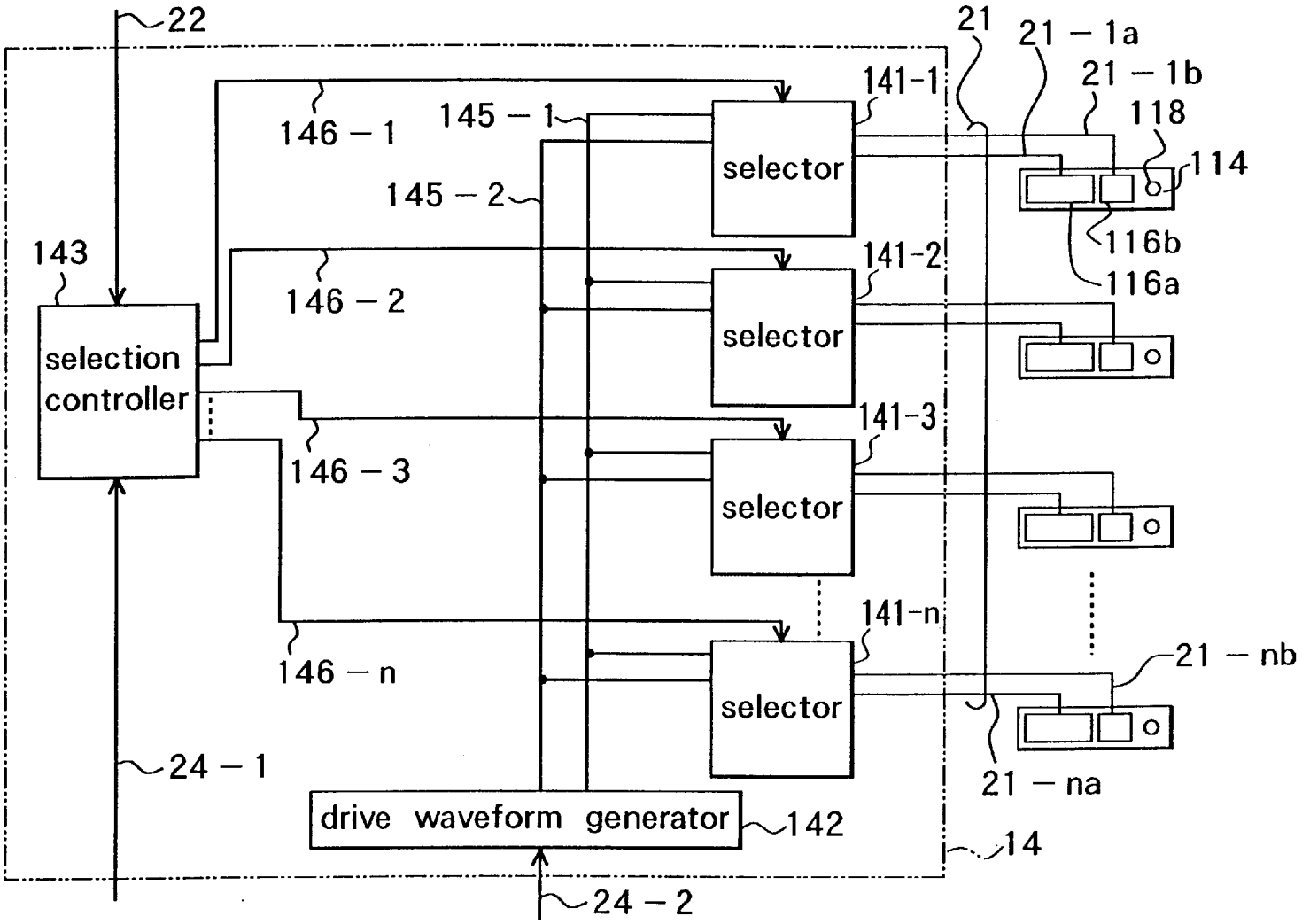
FIG. 19 is a block diagram of a head controller as a drive apparatus of a recording head for an ink-jet printer of a fourth embodiment of the invention.

FIG. 19 is a block diagram of the head controller 14 shown in FIG.4. As shown, the head controller 14 comprises: a plurality of selectors 141-1 to 141-n; a drive waveform generator 142 for generating two kinds of fundamental drive signals 145-1 and 145-2; and a selection controller 143 for controlling the operation of the waveform selectors 141-1 to 141-n; wherein 'n' represents a positive integer equal to the number of the nozzles 118.

The drive signals 145-1 and 145-2 outputted from the drive waveform generator 142 are each branched into 'n' in number to be inputted to the selectors 141-1 to 141-n, respectively. The selection controller 143 inputs selection signals 146-1 to 146-n to the respective selectors 141-1 to 141-n with specific timing. The selection signals 146-1 to 146-n are signals for selecting either the fundamental drive signal 145-1 or 145-2 for each nozzle 118 of the recording head 11 and for instructing to apply the signal to either the piezoelectric element 116*a* or 116*b*. The selectors 141-1 to 141-n each select either the drive signal 145-1 or 145-2 in accordance with the selection signal. The selectors 141-1 to 141-n supply the selected drive signals to the respective piezoelectric elements 116*a* (and 116*b* ) in the ink droplet ejection section as drive signals 21-1*a* (and 21-1*b*) to 21-na (and 21-nb) respectively. The drive signals 21-1*a* to 21-na and 21-1*b* to 21-nb correspond to the drive signal 21 in FIG. 4 and FIG. 19. The selectors 141-1 to 141-n each correspond to a "means for selecting" of the invention.

Although not shown, the drive waveform generator 142 is made up of a microprocessor; a read only memory (ROM) for storing a program executed by the microprocessor; a random access memory (RAM) as a work memory used for particular computations performed by the microprocessor and temporary data storage and so on; a drive waveform storage section made up of nonvolatile memory; a digital-to-analog (D-A) converter for converting digital data read from the storage section into analog data; and an amplifier for amplifying an output of the D-A converter. The drive waveform storage section retains waveform data representing the voltage waveforms of the fundamental drive signals 145-1 and 145-2 for driving the recording head 11. The waveform data items are each read by the microprocessor and converted to analog signals by the D-A converter. The signals are amplified by the amplifier and outputted as the drive signals 145-1 and 145-2. The configuration of the drive waveform generator 142 is not limited to the one described above but may be implemented in any other way.

Figures 20A, 20B:
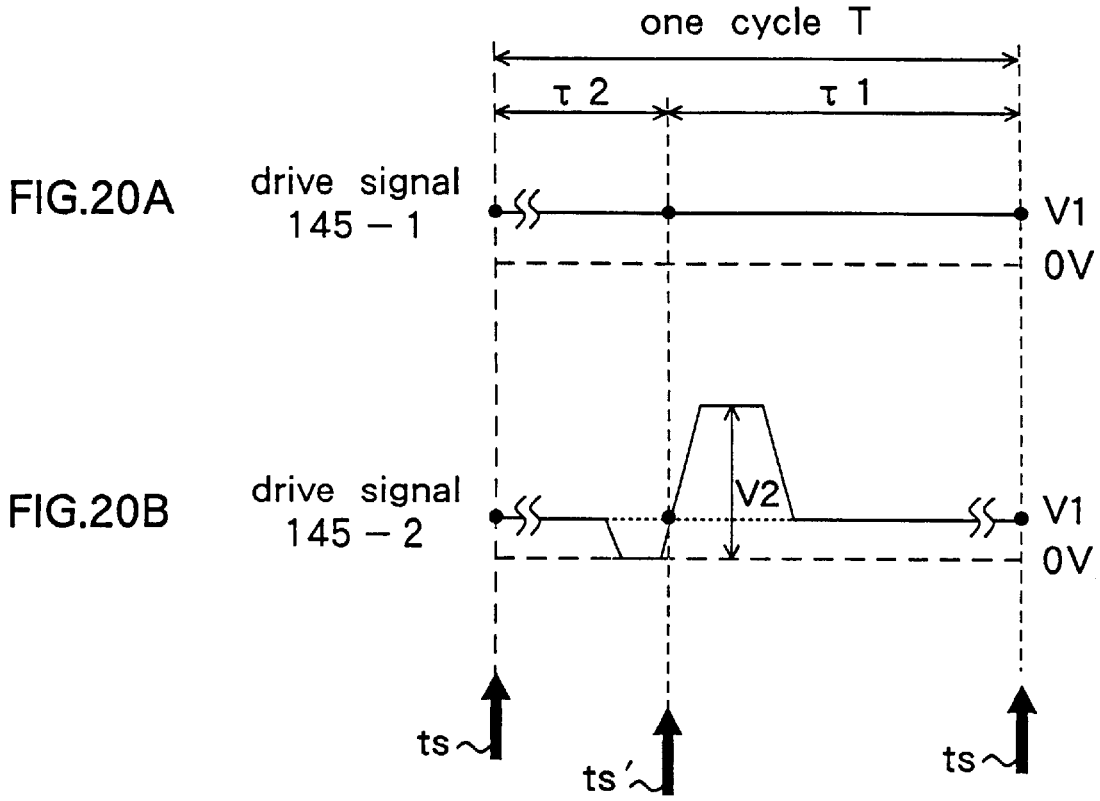
FIG. 20A and FIG. 20B show examples of drive signals outputted from the drive waveform generator shown in FIG. 4.

FIG. 20A and FIG. 20B show examples of one cycle (T) of waveforms of the fundamental drive signals 145-1 and 145-2 outputted from the drive waveform generator A2 FIG. 20A and FIG. 20B each show the drive signals 145-1 and 145-2, respectively. The vertical axis indicates voltage. The horizontal axis indicates time. Time proceeds from left to right in the graphs. Of the drive signals, the drive signal 145-1 has a waveform of a constant voltage (V1) that does not allow ink droplet ejection. Constant voltage V1 is other than 0 V. On the other hand, the drive signal 145-2 has a waveform with a specific undulation. The voltages of the drive signal 145-2 include 0 V and voltage V2 higher than V1 besides reference voltage V1.

As shown in FIG. 20A and FIG. 20B, the drive signals are switched to other signals at switching point ts between the ejection cycles at the selectors 141-1 to 141-n. The drive signals may be switched to others at specific point ts' within the cycle. Switching point ts' is the point at which the drive signal waveform crosses reference voltage V1 in the course of changing from 0 V to voltage V2. Time between switching point ts' and the end of the cycle is shown as $\tau$1 and time between the start point of the cycle and switching point ts' is shown as $\tau$2.

Figures 21A, 21B, 21C:
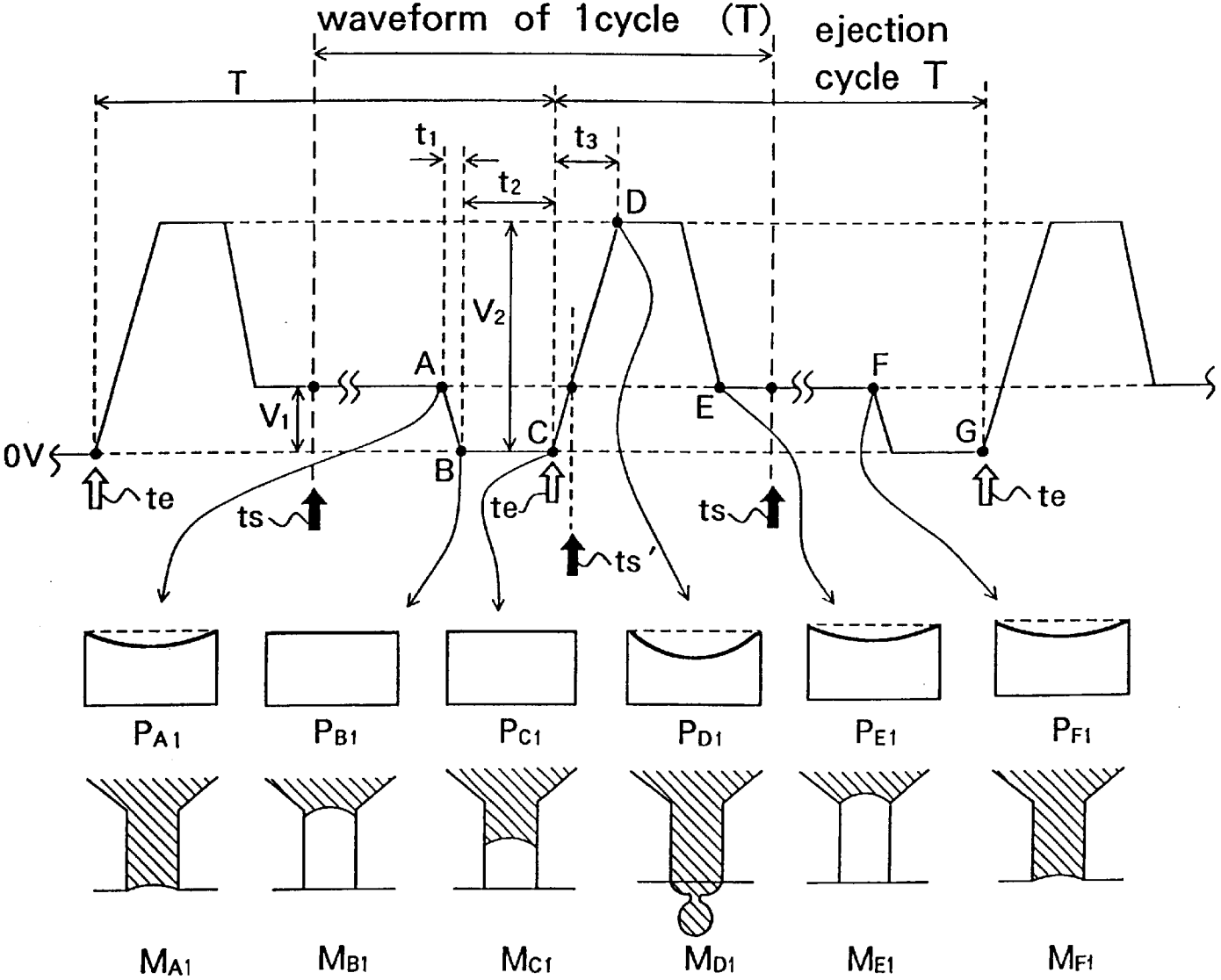
FIG. 21A to FIG. 21C show the relationship among the waveform of the drive signal for ejection shown in FIG. 20A, the state of ink chamber and the meniscus position in the nozzle.

Reference is now made to FIG. 21A to FIG. 21C for describing the significance of the drive signal 145-2. FIG. 21A to FIG. 21C show the relationship among the waveform of the drive signal 145-2, the behavior of the piezoelectric element (the piezoelectric element 116*a* in the embodiment), and the position of extremity of ink in the nozzle 118 (referred to as meniscus position in the following description). FIG. 21A shows the waveform of the fundamental drive signal 145-2. The section divided with switching points ts corresponds to one cycle of the waveform. Letters ts indicate the switching point provided between the cycles. Letters ts' indicate the switching point provided within the cycle. Letters te indicate the ejection start point. FIG. 21B illustrates the changing state of the ink chamber 114 when the drive signal having a waveform as shown in FIG. 21A is applied to the piezoelectric element 116*a*. FIG. 21C illustrates the changing meniscus positions in the nozzle 118. For convenience of description, FIG. 21A illustrates a cyclic repetition of the drive signal of the same waveform.

In FIG. 21A, a first step is the step in which the drive voltage is changed from first voltage V1 (constant) to the voltage of 0 V (from A to B). Time required for the first step is defined as t1. A second step is the step in which the voltage of 0 V is maintained to be on standby (from B to C). Time required for the second step is defined as t2. A third step is the step in which the voltage of 0 V is changed to second voltage V2 (from C to D). Time required for the third step is defined as t3. In the following description, first voltage V1 is called retraction voltage. Second voltage V2 is called ejection voltage.

The recording head 11 is driven at a constant frequency (of the order of 1 to 10 kHz, for example). Cycle T of ink droplet ejection is determined depending on the drive frequency. Points C and G and so on at which the third step is started are the points at which ejection is started (ejection start point 'te'). The first and second steps precede the start of ejection.

At and before point A, as $P_{A1}$ in FIG. 21B, the oscillation plate 113 is slightly bent inward with an application voltage V1 to the piezoelectric element 116*a* and remains at rest. The ink chamber 114 is thereby brought to a state of contraction. At point A, as $M_{A1}$ in FIG. 21C, the meniscus position in the nozzle 118 is nearly equal to the nozzle edge.

Next, the first step is performed for reducing the drive voltage from voltage V1 at point A to the voltage of 0 V at point B. The voltage applied to the piezoelectric element 116*a* is thereby reduced to zero so that the bend in the oscillation plate 113 is eliminated and the ink chamber 114 is expanded as $P_B$ in FIG. 21B. Consequently, the meniscus in the nozzle 118 is retracted towards the ink chamber 114. At point B the meniscus is retracted as deep as $M_B$ in FIG. 21C, that is, moves away from the nozzle edge.

The amount of retraction of the meniscus in the first step is changed by changing the potential difference between points A and B (retraction voltage V1). Therefore it is consequentially possible to adjust the meniscus position at the point of completion of the second step, that is, at the start point of the third step. The meniscus position, that is, the distance between the nozzle edge and the meniscus at the start point of the third step has an effect on the droplet size ejected in the third step. The droplet size is reduced with an increase in the distance. The droplet size is thus reduced by increasing the amount of retraction of the meniscus (to be specific, retraction voltage V1) in the first step.

Next, the second step is performed for maintaining the volume of the ink chamber 114 by fixing the drive voltage to zero so as to keep the oscillation plate 113 unbent during time t2 from point B to point C ($P_{B1}$ to $P_{C1}$ in FIG. 21C). During time t2 ink is continuously fed from the ink cartridge 12. The meniscus position proceeds as far as the state of $M_{C1}$ shown in FIG. 21C at point C.

The amount of movement of the meniscus may be varied by changing time t2 required for the second step. The meniscus position at the start point of the third step is thereby adjusted. As a result, the droplet size is controllable by adjusting time t2. To be specific, the droplet size is reduced with a reduction in time t2.

Next, the third step is performed for abruptly increasing the drive voltage from the voltage of 0V at point C to ejection voltage V2 at point D. Point C is ejection start point te as described above. Since high ejection voltage V2 is applied to the piezoelectric element 116*a* at point D, the oscillation plate 113 is greatly bent inward as $P_{D1}$ in FIG. 21B. The ink chamber 114 is thereby abruptly contracted. Consequently, as $M_D$ in FIG. 21C, the meniscus in the nozzle 118 is pressed towards the nozzle edge at a stretch through which an ink droplet is ejected. The droplet ejected files in the air and lands on the paper 2 (FIG. 4). As described above, the droplet size is reduced with an increase in the distance between the nozzle edge and the meniscus position at point C at which the third step is started.

Since the amount of bend in the oscillation plate 113 changes with the magnitude of ejection voltage V2, the ejected droplet size may be changed by adjusting ejection voltage V2. To be specific, the droplet size is reduced with a reduction in ejection voltage V2.

Next, the drive voltage is educed to V1 again so the oscillation plate 113 is slightly bent inward to be in the initial state ($P_{E1}$ in FIG. 21B). This state is maintained until point F at which the first step of next ejection cycle is started ($P_{F1}$ in FIG. 21B) . At point E at which the drive voltage is reduced to V1 again, as $M_{E1}$ in FIG. 21C, the meniscus position is retreated by the amount nearly corresponding to the total of the volume of ink ejected and the increase in volume of the ink chamber 114. With ink refilling, the meniscus position returns to the position of the nozzle edge, as $M_{F1}$ in FIG. 21C, at point F at which the first step of next ejection cycle is started. This state is similar to $M_A$ at point A.

The cycle of ejection is thus completed. Such a cycle of operation is repeated for each of the nozzles 118 in a parallel manner. Image recording on the paper 2 (FIG. 4) is thereby continuously performed. Time t2 required for the second step is less than the time required for the meniscus retracted in the first step to reach the nozzle edge. Ejection voltage V2 in the third step falls within the range that allows ink droplet ejection. The gradient of voltage in the third step is constant.

Figure 22:
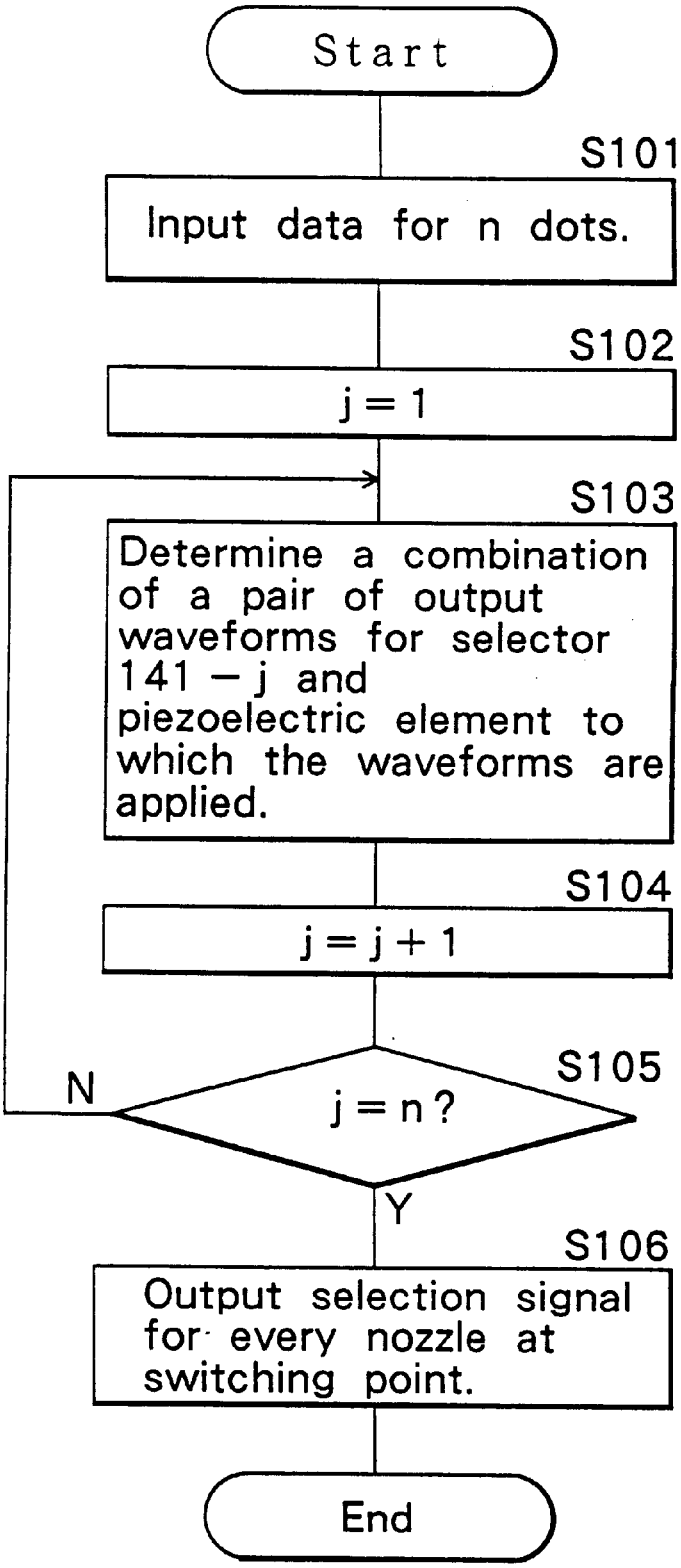
FIG. 22 is a flowchart for illustrating the main operation of the head controller.

Reference is now made to FIG. 22 for describing the operation of the ink-jet printer 1 shown in FIG. 19 as a whole. FIG. 22 shows the main operation of one ejection cycle in the head controller 14 (FIG. 19).

In FIG. 4, printing data is inputted to the ink-jet printer 1 from an information processing apparatus such as a personal computer. The image processor 15 performs specific image processing on the input data (such as expansion of compressed data) and outputs the data as the image printing data 22 to the head controller 14.

On receipt of the image printing data 22 of 'n' dots corresponding to the number of nozzles of the recording head 11 (step S101 in FIG.22), the controller 143 in the head controller 14 determines an ink droplet size for forming a dot for each nozzle 118 based on the image printing data 22. The controller 143 then determines a combination of a pair of drive signal waveforms to be selected at the selectors 141-1 to 141-n and the piezoelectric element 116*a* or 116*b* to which the drive signal is applied, based on the determined droplet sizes. To be specific, the controller 143 determines the drive signal waveform to be selected at the selector 141-j while incrementing variable 'j' from '1' to 'n' and determines to which of the piezoelectric elements 116*a* and 116*b* the drive signal is applied (steps S102 to S105). The selected fundamental drive signal 145-1 or 145-2 may be switched every cycle (at switching point ts) so as to use the original waveforms as they are. Alternatively, the selected drive signal 145-1 or 145-2 may be switched at switching points ts' during the cycle so as to generate a composite waveform. Furthermore, the selected drive signal 145-1 or 145-Z may be switched at both points between the cycles and points during the cycle.

For example, a combination of drive waveforms and the piezoelectric element that achieves a large droplet is selected for representing high density and a droplet of small size for representing low density or high resolution. For representing a delicate halftone image, a combination of drive waveforms and the piezoelectric element that achieves a droplet size slightly different from neighboring dots is selected. If there are variations in droplet ejection characteristics among the nozzles, a combination of drive waveforms and the piezoelectric element that adjusts the variations may be selected.

Having determined the combination patterns of the drive waveforms and the piezoelectric element for all the waveform selectors 141-1 to 141-n whose number is 'n' (Y in step S105), the controller 143 outputs the selection signals 146-1 to 146-n to the respective selectors 141-1 to 141-n for instructing the selected drive signals having the determined waveforms and the selected piezoelectric element (116*a* or 116*b*) to which the drive signals are applied. The controller 143 outputs the selection signals at switching point ts between the cycles or points ts' during the cycle, or both (step S106).

Based on the selection signal 146-1 inputted at the points described above, the selector 141-1 selects the drive signal 145-1 or 145-2 to supply to each of the piezoelectric elements 116*a* and 116*b* of the corresponding nozzle. The same applies to the other selectors 141-2 to 141-n. The drive signal 145-1 or 145-2 having the waveform as shown in FIG. 20A and 20B or the signal having the composite waveform is thereby supplied to the piezoelectric element 116*a* of each nozzle in the recording head 11 as the drive signal 21-1*a* to 21-na. The composite waveform is generated by switching the drive signals 145-1 and 145-2 at points ts' during the cycle. At the same time, the drive signal 145-1 or 145-2 or the signal having the composite waveform is thereby supplied to the piezoelectric element 116*b* of each nozzle in the recording head 11 as the drive signal 21-1*b* to 21-nb. The three steps described with reference to FIG. 21A to FIG. 21C are performed on the piezoelectric elements 116*a* and 116*b* for each nozzle of the recording head 11, based on the voltage waveform of the supplied drive signal. An ink droplet of size specified for each nozzle is thereby ejected.

FIG. 23 to FIG. 26 show examples of the drive signal waveforms applied to the piezoelectric elements 116*a* and 116*b*, attention being focused on a specific nozzle. In the examples the total of (12+1) types of ejection patterns are obtained by switching the selection between the drive signals 145-1 and 145-2 at point ts between the cycles and point ts' during the cycle and switching between the piezoelectric elements 116*a* and 116*b* to which the drive signals are applied. The type of '+1' means the pattern that does not allow ink droplet ejection wherein the drive signal 145-1 (FIG. 20A) of a constant voltage is applied to both piezoelectric elements 116*a* and 116*b* in both first part τ2 and second part τ1. However, this pattern is not shown in FIG. 23 to FIG. 26.

Referring to FIG. 23 to FIG. 26, the ejection patterns will be described. In the tables, 'name' means the name of each ejection pattern. The piezoelectric elements 116*a* and 116*b* to which the drive signals are applied are each represented by 'a' and 'b' respectively, in the 'piezoelectric element' column. The 'drive signal waveform applied' shows the voltage waveforms of the drive signals actually applied to the piezoelectric elements 116*a* and 116*b* through selection and composition of the waveforms. '1' means that the drive signal 145-1 shown in FIG. 20A is selected. '2' means that the drive signal 145-2 shown in FIG. 20B is selected. On the waveforms shown, the dot indicates the point at which switching is actually performed. In the 'retraction step' and 'ejection step' columns, 'a' and 'b' each indicates which of the piezoelectric elements 116*a* and 116*b* allows meniscus retraction in the first step and ink droplet ejection in the third step, respectively. The 'a+b' indicates that both piezoelectric elements 116*a* and 116*b* allow retraction or ejection. The '-' means that the step is not performed.

As shown in FIG. 23, ejection patterns $\alpha 1$ to $\alpha 3$ each allow retraction by the piezoelectric element 116*b* only. Ejection pattern $\alpha 1$ allows ejection by the piezoelectric element 116*b* as well. Ejection pattern $\alpha 2$ allows ejection by the piezoelectric element 116*a*. Ejection pattern $\alpha 3$ allows ejection by both piezoelectric elements 116*a* and 116*b*.

To be specific, in ejection pattern $\alpha 1$, the drive signal 145-1 is selected both in first part $\tau 2$ and second part $\tau 1$ for the piezoelectric element 116*a*. The drive signal 145-2 is selected both in first part $\tau 2$ and second part $\tau 1$ for the piezoelectric element 116*b*. In ejection pattern $\alpha 2$, the drive signal 145-1 is selected in first part $\tau 2$ and the drive signal 145-2 is selected in second part $\tau 1$ for the piezoelectric element 116*a*. The drive signal 145-2 is selected in first part $\tau 2$ and the drive signal 145-1 is selected second part $\tau 1$ for the piezoelectric element 116*b*. In ejection pattern $\alpha 3$, the drive signal 145-1 is selected in first part $\tau 2$ and the drive signal 145-2 is selected in second part $\tau 1$ for the piezoelectric element 116*a*. The drive signal 145-2 is selected both in first part $\tau 2$ and second part $\tau 1$ for the piezoelectric element 116*b*. Therefore, the waveforms each applied to the piezoelectric elements 116*a* and 116*b* in ejection pattern $\alpha 1$ and the waveform applied to the piezoelectric element 116*b* in ejection pattern $\alpha 3$ are the same as the waveforms of the drive signals 145-1 and 145-2 shown in FIG. 20A and FIG. 20B, respectively. The other waveforms are newly created composite waveforms.

As shown in FIG. 24, ejection patterns $\beta 1$ to $\beta 3$ each allow retraction by the piezoelectric element 116*a* only. Ejection pattern $\beta 1$ allows ejection by the piezoelectric element 116*b*. Ejection pattern $\beta 2$ allows ejection by the piezoelectric element 116*a* as well. Ejection pattern $\beta 3$ allows ejection by both piezoelectric elements 116*a* and 116*b*. The details of the ejection patterns are similar to those shown in FIG. 23 and descriptions thereof are omitted.

As shown in FIG. 25, ejection patterns $\gamma 1$ to $\gamma 3$ each allow retraction by both piezoelectric elements 116*a* and 116*b*. Ejection pattern $\gamma 1$ allows ejection by the piezoelectric element 116*b*. Ejection pattern $\gamma 2$ allows ejection by the piezoelectric element 116*a*. Ejection pattern $\gamma 3$ allows ejection by both piezoelectric elements 116*a* and 116*b*. The details of the ejection patterns are similar to those shown in FIG. 23 and descriptions thereof are omitted.

As shown in FIG. 26, ejection patterns $\delta 1$ to $\delta 3$ each do not allow retraction but allow ejection. Ejection pattern $\delta 1$ allows ejection by the piezoelectric element 116*b*. Ejection pattern $\delta 2$ allows ejection by the piezoelectric element 116*a*. Ejection pattern $\delta 3$ allows ejection by both piezoelectric elements 116*a* and 116*b*. The details of the ejection patterns are similar to those shown in FIG. 23 and descriptions thereof are omitted.

In any of ejection patterns $\alpha 1$ to $\alpha 3$ shown in FIG. 23, as described above, the meniscus is retracted by applying the drive signal 145-2 to the piezoelectric element 116*b* in the first part $\tau 2$ and the drive signal 145-2 is selected in the second part $\tau 1$. However, in the ejection step of the second part $\tau 1$, with an increase in suffix 'i' of $\alpha i$, the piezoelectric element to which the signal is applied changes from the element 116*b* only to the element 116*a* only, and further to both elements 116*a* and 116*b*. As described above, since the piezoelectric element 116*b* has a surface area smaller than the piezoelectric element 116*a*, the amount of change in volume of the ink chamber 114 effected by the element 116*a* is greater than that effected by the element 116*b* with an application of the same drive signal 145-2. Similarly, the amount of change in volume of the ink chamber 114 effected by both elements 116*a* and 116*b* is greater than that effected by the element 116*a* only. Therefore, the ejected ink droplet size increases in order of ejection patterns $\alpha 1$ to $\alpha 3$.

Similarly, in FIG. 24, the ejected droplet size increases from ejection patterns 1 to 3. The same applies to the group of ejection patterns $\alpha 1$ to $\alpha 3$ shown in FIG. 25 and the group of ejection patterns $\delta 1$ to $\delta 3$ shown in FIG. 26. In each group the droplet size increases with an increase in suffix 'i'.

For example, the ejection patterns with the same suffixes of the group of ejection patterns $\alpha 1$ to $\alpha 3$ (group $\alpha$) and the group of ejection patterns $\beta 1$ to $\beta 3$ (group $\beta$) being compared to each other, the amount of retracting the meniscus is greater in group $\beta$ than in group $\alpha$ since retraction is performed with the piezoelectric element 116*b* whose surface area is smaller in group $\alpha$ while retraction is performed with the piezoelectric element 116*a* whose surface area is greater in group $\beta$. Therefore, in this respect, a smaller droplet tends to be obtained in group $\beta$ as long as the ejection patterns with the same suffixes are compared to each other. In group $\beta$, however, the meniscus shifts due to the motion of the piezoelectric element 116*a* that allows a greater change in volume in the specific period immediately after ejection starts on completion of the second step (the period during which the voltage changes from 0 V to reference voltage V1). Therefore, a reverse effect may result, depending on the surface area ratio between the piezoelectric elements 116*a* and 116*b* and the ratio of reference voltage V1 to ejection voltage V2 (that is, a greater droplet may be obtained in group $\beta$). The same applies to the relationship between group $\beta$ shown in FIG. 24 and group $\gamma$ shown in FIG. 25 and the relationship between group $\delta$ shown in FIG. 26 and the other groups. Therefore, the ejected droplet size is controllable by appropriately determining the surface area ratio between the piezoelectric elements 116*a* and 116*b* and the ratio of reference voltage V1 to ejection voltage V2.

Attention being focused on one particular cycle, the ejection patterns of the nozzles are independent of one another. It is therefore possible to vary the sizes of droplets ejected through the nozzles from one another while synchronizing ejection performed in all the nozzles and to adjust to variations among the nozzles by changing the ejection patterns in accordance with the ejection characteristics of the nozzles.

According to the embodiment described so far, the two piezoelectric elements 116*a* and 116*b* having ink drive capacities different from each other are provided for each ink chamber 114 corresponding to each nozzle. To each of the piezoelectric elements 116*a* and 116*b*, a selection of a plurality of fundamental drive signals is supplied by switching between the signals at point ts between the ejection cycles and points ts' during the cycle. As a result, droplet ejection patterns far more than the fundamental waveforms are obtained. A variety of image representations is thus achieved. In other words, control for various ink droplet ejections is achieved without generating many types of waveforms at the drive waveform generator 142. As a result, a load applied to the generator 142 as well as the head controller 14 is reduced.

The invention is not limited to the foregoing embodiment but may be practiced in still other ways.

Figure 27:
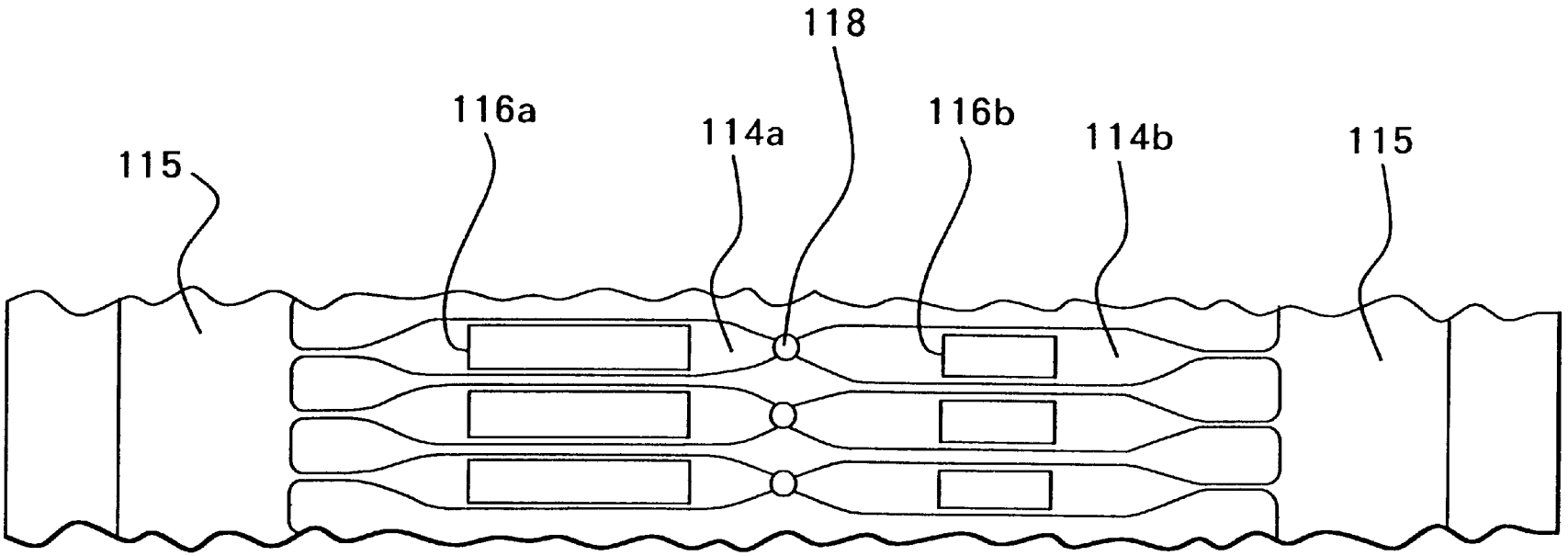
FIG. 27 is a top view of a modification example of a recording head used in the ink-jet printer of the embodiments of the invention.

For example, in the foregoing embodiment, the one ink chamber 114 is provided for the single nozzle 118 and the two piezoelectric elements 116*a* and 116*b* corresponding to the ink chamber 114 are provided. Alternatively, as shown in FIG. 27, for example, two ink chambers 114*a* and 114*b* may be provided for the single nozzle 118 and the piezoelectric elements 116*a* and 116*b* each corresponding to the ink chambers 114*a* and 114*b*, respectively, may be provided. FIG. 27 is a top view of part of the recording head 11 wherein like numerals are assigned to the components similar to those shown in FIG. 5 and the oscillation plate 13 is omitted. In the configuration as shown, the behavior of the piezoelectric element 116*a* with regard to the one ink chamber 114*a* has less effect on the state of the other ink chamber 114*b*. As a result, crosstalk between the piezoelectric elements 116*a* and 116*b* is reduced and printed images of higher quality will be achieved.

Although the drive signals shown in FIG. 20A and FIG. 20B are used as the fundamental waveforms, signals having any other waveform may be applied. That is, the drive waveform generator 142 generates the one type of drive signal 145-2 as the drive signal having a specific undulation besides the constant voltage waveform (the drive signal 145-1) in the foregoing embodiment. Alternatively, two or more drive signals each having a specific undulation may be generated by appropriately determining retraction voltage V1, ejection voltage V2 and time t2 required for the second step. These drive signals may be used for waveform selection and composition. In this case, more ejection patterns are obtained.

Although the two piezoelectric elements whose ink drive capacities are different from each other are provided for every nozzle in the foregoing embodiment, three or more piezoelectric elements whose ink drive capacities are different from each other may be provided for every nozzle. To each piezoelectric element, the signal having a waveform selected or composed out of the two fundamental waveforms may be applied. More ejection patterns are thereby obtained.

Furthermore, three or more piezoelectric elements whose ink drive capacities are different from each other may be provided and three or more drive signals each having a specific undulation may be used as the fundamental waveforms. Selection and composition of the waveforms to be applied to the piezoelectric elements may be performed based on the fundamental waveforms. Still more ejection patterns are thereby obtained.

Although the ink drive capacities of the piezoelectric elements 116*a* and 116*b* are made different from each other in the foregoing embodiment by varying the surface areas thereof, the different capacities may be obtained by any other way. For example, the materials and thicknesses thereof may be different from each other. For example, a reduction in thicknesses increases the ink drive capacity.

Furthermore, the piezoelectric elements 116*a* and 116*b* may be made of the same material and have the same surface area and thickness so as to have the same ink drive capacity. In this case, referring to FIG. 23 to FIG. 26, ejection patterns $\alpha$1, $\alpha$2, $\beta$1 and $\beta$2 are equal to one another. Patterns $\alpha$3 and $\beta$3 are equal as well. Patterns $\gamma$1 and $\gamma$2 are equal and patterns $\delta$1 and $\delta$2 are equal. Therefore, the number of ejection patterns is six which is fewer than twelve patterns in the foregoing embodiment (FIG. 23 to FIG. 26) but the variety of ejection patterns is still obtained, compared to the case wherein a single piezoelectric element is used. Alternatively, three or more piezoelectric elements having the same ink drive capacities may be provided.

Although the foregoing embodiment provides waveform selection and composition focusing on control of ink droplet sizes, waveform selection and composition focusing on control of droplet velocity may be performed. Furthermore, both droplet sizes and velocity may be controlled.

Although drive signal selection is switched at not only points between the ejection cycles but also points during the cycle, selection may be switched at either the former points or the latter points. However, more waveforms are obtained by switching at both points.

As thus described, the foregoing embodiments may be combined so as to provide a plurality of piezoelectric elements for each nozzle. To each piezoelectric element some of the drive signals may be selected and supplied, the signals including those for modulating an ink droplet size and those for suppressing minute droplets accompanying the ejected droplet. Control of droplet ejection through the nozzle and control of suppressing satellite droplets are performed by the drive signals. As a result, the ejection status such as the droplet size may be changed variously. Generation of unwanted satellite droplets is suppressed as well.

Furthermore, when the piezoelectric element for generating a pressure for ejection is shifted and ejection is performed, a drive signal may be applied to the piezoelectric element for generating an auxiliary pressure, the drive signal preventing the piezoelectric element for generating an auxiliary pressure from shifting due to the pressure generated by displacement of the piezoelectric element for generating an ejection pressure. The displacement of the piezoelectric element for generating an auxiliary pressure is thereby prevented due to the displacement of the piezoelectric element for generating an ejection pressure when the ink droplet is ejected by the piezoelectric element for generating an ejection pressure. As a result, the ejection pressure thus generated is used for the droplet ejection with little loss. The ejection characteristic is thus maintained. Consequently, an intended droplet size and velocity are obtained and constant droplet ejection is steadily performed.

As previously described, the piezoelectric element for generating an auxiliary pressure may generate a pressure for suppressing minute droplets accompanying the ejected ink droplet. As a result, constant droplet ejection is steadily performed while suppressing unwanted accompanying droplets.

In addition, several types of drive signals may be generated, including signals for modulating the droplet size and auxiliary drive signals for canceling out the effects resulting from droplet ejection performed by another nozzle. To each piezoelectric element some of the drive signals may be selected and supplied. As a result, an effect of crosstalk among the nozzles is reduced. Variations in the droplet ejection status among the nozzles are thereby reduced and high-quality print output is steadily obtained.

Obviously many modifications and variations of the present invention are possible in the light of the above teachings. It is therefore to be understood that within the scope of the appended claims the invention may be practiced otherwise than as specifically described.

What is claimed is:

1. An ink-jet printer comprising:

a droplet outlet orifice through which an ink droplet is ejected;

an ink chamber for supplying ink to the outlet orifice;

first pressure generating means for generating a first pressure in response to a first voltage waveform for ejecting the ink droplet through the outlet orifice by changing a volume of the ink chamber through displacement thereof;

second pressure generating means for generating a second pressure in response to a second voltage waveform for aiding ejection of the ink droplet and suppressing generation of minute ink droplets accompanying the ink droplet ejected through the outlet orifice by changing the volume of the ink chamber through displacement thereof; and ejection control means for controlling a state of the displacements of the first pressure generating means and the second pressure generating means by forming the first voltage waveform as two pulses spaced apart by a first time period and by forming the second voltage waveform as two pulses spaced apart by a second time period longer than the first time period.

2. An apparatus for driving a recording head for an ink-jet printer including:

a droplet outlet orifice through which an ink droplet is ejected;

an ink chamber for supplying ink to the outlet orifice;

first pressure generating means for generating in response to a first voltage waveform a first pressure for ejecting the ink droplet through the outlet orifice by changing a volume of the ink chamber through displacement thereof; and second pressure generating means for generating in response to a second voltage waveform a second pressure for aiding ejection of the ink droplet and suppressing generation of minute ink droplets accompanying the ink droplet ejected through the outlet orifice by changing the volume of the ink chamber through displacement thereof;

the apparatus comprising:

drive signal generating means for generating the first voltage waveform and the second voltage waveform for effecting the displacements caused by the first pressure generating means and the second pressure generating means, wherein the first voltage waveform is formed with two pulses spaced apart by a first time period and the second voltage waveform is formed with two pulses spaced apart by a second time period longer that the first time period; and controlling means for controlling a state of a supply of the first voltage waveform and the second voltage to the first pressure generating means and the second pressure generating means.

3. A method for driving a recording head for an ink-jet printer including:

a droplet outlet orifice through which an ink droplet is ejected;

an ink chamber for supplying ink to the outlet orifice;

first pressure generating means; and second pressure generating means;

the method comprising the steps of:

generating an ejection pressure for ejecting the ink droplet through the outlet orifice by applying a drive signal for ejection having a first specific waveform formed of two pulses spaced apart by a first time period to the first pressure generating means to change a volume of the ink chamber through displacement thereof;

generating an auxiliary pressure for suppressing generation of minute ink droplets accompanying the ink droplet ejected through the outlet orifice by applying an auxiliary drive signal having a second specific waveform formed of two pulses spaced apart by a second time period longer than the first time period to the second pressure generating means to change the volume of the ink chamber through displacement thereof; and controlling a state of generation of the ejection pressure and a state of generation of the auxiliary pressure.

4. An ink-jet printer comprising:

a droplet outlet orifice through which an ink droplet is ejected;

an ink chamber for supplying ink to the outlet orifice, the ink chamber having a wall;

first pressure generating means provided on the wall of the ink chamber for generating a first pressure in response to a first voltage waveform formed of two pulses spaced apart by a first time period for ejecting the ink droplet through the outlet orifice by changing a volume of the ink chamber through displacement of the wall;

second pressure generating means provided on the wall of the ink chamber for generating a second pressure in response to a second voltage waveform formed of two pulses spaced apart by a second time period longer than the first time period for assisting with ejection of the ink droplet through the outlet orifice by changing the volume of the ink chamber through displacement of the wall; wherein the first pressure generating means is positioned further from the outlet orifice than the second pressure generating means.

5. The ink-jet printer according to claim 4, wherein the second pressure generating means generates the second pressure for suppressing generation of minute ink droplets accompanying the ink droplet ejected.

6. An apparatus for driving a recording head for an ink-jet printer including:

a droplet outlet orifice through which an ink droplet is ejected;

an ink chamber for supplying ink to the outlet orifice, the ink chamber having a wall;

first pressure generating means provided on the wall of the ink chamber for generating a first pressure by changing a volume of the ink chamber through displacement of the wall; and second pressure generating means provided on the wall of the ink chamber for generating a second pressure by changing the volume of the ink chamber through displacement of the ink, the first pressure generating means being positioned further from the outlet orifice than the second pressure generating means;

the apparatus comprising:

main drive signal generating means for generating a main drive signal having two pulses separated by a first time period for causing the first pressure generating means to generate the first pressure for ejecting the ink droplet through the outlet orifice and for generating an auxiliary drive signal having two pulses separated by a second time period longer that the first time period for causing the second pressure generating means to generate the second pressure for assisting with ejection of the ink droplet through the outlet orifice; and control means for controlling the main drive signal and the auxiliary drive signal so that the main drive signal and the auxiliary drive signal are respectively supplied to the first pressure generating means and the second pressure generating means.

7. The apparatus according to the claim 6, wherein the second pressure generating means generates upon application of the auxiliary drive signal, the second pressure for suppressing generation of minute ink droplets accompanying the ink droplet.

8. A method of driving a recording head for an ink-jet printer including:

an ink chamber for supplying ink to the outlet orifice, the ink chamber having a wall;

first pressure generating means provided on the wall of the ink chamber for generating a first pressure by changing a volume of the ink chamber through displacement of the wall; and second pressure generating means provided on the wall of the ink chamber for generating a second pressure by changing the volume of the ink chamber through displacement of the wall, the first pressure generating means being positioned further from the outlet orifice than the second pressure generating means;

the method comprising the steps of:

applying a main drive signal having two pulses spaced apart by a first time period to the first pressure generating means for generating pressure for ejecting the ink droplet through the outlet orifice; and applying an auxiliary drive signal having two pulses spaced apart by a second time period longer than the first time period to the second pressure generating means for generating a pressure for assisting with ejection of the ink droplet through the outlet orifice.

9. The method according to claim 8, wherein the auxiliary drive signal applied to the second pressure generating means is provided for generating the second pressure for suppressing generation of minute ink droplets accompanying the ink droplet.

10. An ink-jet printer comprising:

a droplet outlet orifice through which an ink droplet is ejected;

a plurality of energy generating means for generating energy for ejecting the ink droplet through the outlet orifice; and a plurality of selection means provided for respective energy generating means for selecting any of a plurality of drive signals for driving a corresponding energy generating means and for supplying a selected drive signal to the corresponding energy generating means, wherein each of the energy generating means have different ink ejection drive capacities in response to an application of one of the drive signals.

11. An ink-jet printer comprising:

a droplet outlet orifice through which an ink droplet is ejected;

a plurality of energy generating means for generating energy for ejecting the ink droplet through the outlet orifice; and a plurality of selection means provided for respective energy generating means for selecting any of a plurality of drive signals for driving a corresponding energy generating means and for supplying a selected drive signal to the corresponding energy generating means, wherein each of the selection means switches a selection of a first drive signal to a second drive signal at a point between a cycle wherein the ink droplet is ejected and a next cycle.

12. An ink-jet printer comprising:

a droplet outlet orifice through which an ink droplet is ejected;

a plurality of energy generating means for generating energy for ejecting the ink droplet through the outlet orifice; and a plurality of selection means provided for respective energy generating means for selecting any of a plurality of drive signals for driving a corresponding energy generating means and for supplying a selected drive signal to the corresponding energy generating means, wherein each of the selection means switches a selection of a first drive signal to a second drive signal at any point including a point during a cycle wherein the ink droplet is ejected.

13. An apparatus for driving a recording head for an ink-jet printer including:

a droplet outlet orifice through which an ink droplet is ejected; and a plurality of energy generating means for generating energy for ejecting the ink droplet through the outlet orifice;

the apparatus comprising:

drive signal generating means for generating a plurality of drive signals for driving the energy generating means; and a plurality of selection means provided for respective energy generating means for selecting any of the drive signals and for supplying a selected drive signal to a corresponding energy generating means, wherein each of the energy generating means have different ink ejection drive capacities in response to an application of one of the drive signals.

14. An apparatus for driving a recording head for an ink-jet printer including:

a droplet outlet orifice through which an ink droplet is ejected; and a plurality of energy generating means for generating energy for ejecting the ink droplet through the outlet orifice;

the apparatus comprising:

drive signal generating means for generating a plurality of drive signals for driving the energy generating means; and a plurality of selection means provided for respective energy generating means for selecting any of the drive signals and for supplying a selected drive signal to a corresponding energy generating means, wherein each of the selection means switches a selection of a first drive signal to a second drive signal at a point between a cycle wherein the ink droplet is ejected and a next cycle.

15. An ink-jet printer for driving a recording head for an ink-jet printer including:

a droplet outlet orifice through which an ink droplet is ejected; and a plurality of energy generating means for generating energy for ejecting the ink droplet through the outlet orifice;

the apparatus comprising:

drive signal generating means for generating a plurality of drive signals for driving the energy generating means; and a plurality of selection means provided for respective energy generating means for selecting any of the drive signals and for supplying a selected drive signal to a corresponding energy generating means, wherein each of the selection means switches a selection of a first drive signal to a second drive signal at any point including a point during a cycle wherein the ink droplet is ejected.

16. A method of driving a recording head for an ink-jet printer including:

a droplet outlet orifice through which an ink droplet is ejected; and a plurality of energy generating means for generating energy for having the ink droplet ejected through the outlet orifice;

the method comprising the steps of:

selecting, for each of the energy generating means, any of a plurality of drive signals for driving the energy generating means; and supplying a selected drive signal to a corresponding energy generating means, wherein each of the energy generating means has different respective ink ejection drive capacities in response to an application of one of the drive signals.

17. A method of driving a recording head for an ink-jet printer including:

a droplet outlet orifice through which an ink droplet is ejected; and a plurality of energy generating means for generating energy for having the ink droplet ejected through the outlet orifice;

the method comprising the steps of:

selecting, for each of the energy generating means, any of a plurality of drive signals for driving the energy generating means; and supplying a selected drive signal to a corresponding energy generating means, wherein a selection of a first drive signal is switched to a second drive signal at a point between a cycle wherein the ink droplet is ejected and a next cycle.

18. A method of driving a recording head for an ink-jet printer including:

a droplet outlet orifice through which an ink droplet is ejected; and a plurality of energy generating means for generating energy for having the ink droplet ejected through the outlet orifice;

the method comprising the steps of:

selecting, for each of the energy generating means, any of a plurality of drive signals for driving the energy generating means; and supplying a selected drive signal to a corresponding energy generating means, wherein a selection of a first drive signal is switched to a second drive signal at any point including a point during a cycle wherein the ink droplet is ejected.

19. An ink-jet printer comprising:

a droplet outlet orifice through which an ink droplet is ejected;

an ink chamber for supplying ink to the outlet orifice;

pressure generating means for generating a pressure for ejecting the ink droplet through the outlet orifice by changing a volume of the ink chamber through displacement thereof; and ejection control means for initially displacing the pressure generating means in a direction of contracting the ink chamber to cause the ink droplet to be ejected through the outlet orifice and then further displacing the pressure generating means in the direction of contracting the ink chamber.

20. An ink-jet printer comprising:

a droplet outlet orifice through which an ink droplet is ejected;

an ink chamber for supplying ink to the outlet orifice;

pressure generating means for generating a pressure for ejecting the ink droplet through the outlet orifice by changing a volume of the ink chamber through displacement thereof; and ejection control means for providing the pressure generating means with a drive signal having a voltage that varies from the reference voltage to an ink ejection voltage, so as to displace the pressure generating means in a direction of contracting the ink chamber to reduce a volume of the ink chamber to a contracted state to cause the ink droplet to be ejected through the outlet orifice, and for maintaining the ink ejection voltage for a predetermined period of time, and then further displacing the pressure generating means in the direction of contracting the ink chamber.

21. A method of ejecting ink for an ink-jet printer having a droplet outlet orifice through which an ink droplet is ejected, an ink chamber for supplying ink to the outlet orifice, a pressure generator for generating a pressure to cause the ink droplet to be ejected through the outlet orifice by changing a volume of the ink chamber through the displacement thereof, and an ejection controller for providing the pressure generator with drive signal, the method comprising the steps of:

initially displacing the pressure generator in a direction of contracting the ink chamber, so as to eject an ink droplet through the outlet orifice; and further displacing the pressure generator in the direction of contracting the ink chamber, thereby cutting off a tail of the ink droplet generated when the ink droplet is ejected through the outlet orifice.

* * * * *